US010267083B2

(12) United States Patent
Briese et al.

(10) Patent No.: US 10,267,083 B2
(45) Date of Patent: Apr. 23, 2019

(54) TACTILE SPACER FRAME ASSEMBLY AND LOCKING MEMBER

(71) Applicant: GED INTEGRATED SOLUTIONS, INC., Twinsburg, OH (US)

(72) Inventors: William Briese, Hinckley, OH (US); Clifford J. Weber, Richfield, OH (US); John Grismer, Cuyahoga Falls, OH (US)

(73) Assignee: GED Integrated Solutions, Inc., Twinsburg, OH (US)

( * ) Notice: Subject to any disclaimer, the term of this patent is extended or adjusted under 35 U.S.C. 154(b) by 0 days.

(21) Appl. No.: 15/720,892

(22) Filed: Sep. 29, 2017

(65) Prior Publication Data

US 2018/0094476 A1 Apr. 5, 2018

Related U.S. Application Data

(60) Provisional application No. 62/402,312, filed on Sep. 30, 2016.

(51) Int. Cl.

| | |
|---|---|
| ***E06B 3/67*** | (2006.01) |
| ***E06B 3/673*** | (2006.01) |
| ***B21D 53/74*** | (2006.01) |

(52) U.S. Cl.

CPC ..... *E06B 3/67313* (2013.01); *B21D 53/74* (2013.01)

(58) Field of Classification Search

CPC ..... E06B 3/67313; B21D 53/74

See application file for complete search history.

(56) References Cited

U.S. PATENT DOCUMENTS 1,536,038 A * 4/1925 Bishop ..... B21D 53/74 29/514
1,891,316 A * 12/1932 Nyberg ..... B21D 53/74 72/348

(Continued)

FOREIGN PATENT DOCUMENTS

DE 102004027527 A1 8/2005
WO WO2005/075783 A1 8/2005

OTHER PUBLICATIONS

International Search Report for PCT App. PCT/US2015/030310, dated Aug. 10, 2015 (11 pages).

(Continued)

*Primary Examiner* — Adriana Figueroa

(74) *Attorney, Agent, or Firm* — Tarolli, Sundheim, Covell, & Tummino, LLP; John A. Yirga, Esq.

(57) ABSTRACT

A spacer frame assembly and method of assembly includes a substantially linear channel comprising two lateral walls and a base wall. The channel has first and second ends that when assembled, includes at least three sides and corresponding corners between each of said sides. The first end includes a connecting structure and the second end includes an opposite frame end. The opposite frame end has an opposite channel for receiving a nose portion of said connecting structure. The opposite channel includes stiffening flanges extending inwardly from the lateral walls relative to the channel. The connecting structure further includes a first aperture in the base wall comprising a first projection into the channel and the opposite channel comprises a second aperture in the base wall comprising a second projection into the channel. Wherein the first projection tactilely interweaves with the second projection when the spacer frame is assembled.

18 Claims, 35 Drawing Sheets

(56) References Cited

U.S. PATENT DOCUMENTS

| | | | | |
|---|---|---|---|---|
| 2,961,663 | A * | 11/1960 | Lenz, Jr. | B21D 53/74 4/657 |
| 4,222,209 | A | 9/1980 | Peterson | |
| 4,513,546 | A | 4/1985 | Gow | |
| 4,628,582 | A | 12/1986 | Leopold | |
| 4,822,205 | A | 4/1989 | Berdan | |
| 5,012,538 | A * | 5/1991 | Timm | A47C 19/005 5/200.1 |
| 5,105,591 | A | 4/1992 | Leopold | |
| 5,177,916 | A | 1/1993 | Misera et al. | |
| 5,295,292 | A | 3/1994 | Leopold | |
| 5,313,761 | A | 5/1994 | Leopold | |
| 5,361,476 | A | 11/1994 | Leopold | |
| 5,439,716 | A | 8/1995 | Larsen | |
| 5,531,047 | A | 7/1996 | Leopold | |
| 5,644,894 | A | 7/1997 | Hudson | |
| 5,678,377 | A * | 10/1997 | Leopold | E06B 3/667 52/314 |
| 5,813,191 | A | 9/1998 | Gallagher | |
| 7,021,110 | B2 | 4/2006 | Rosskamp | |
| 7,448,246 | B2 | 11/2008 | Briese et al. | |
| 7,610,681 | B2 | 11/2009 | Calcei et al. | |
| 7,739,851 | B2 | 6/2010 | Davis et al. | |
| 7,802,365 | B2 | 9/2010 | McGlinchy | |
| 7,827,761 | B2 | 11/2010 | Buchanan et al. | |
| 7,856,791 | B2 | 12/2010 | Rosskamp | |
| 7,950,194 | B2 | 5/2011 | Rosskamp et al. | |
| 8,001,742 | B2 | 8/2011 | Briese et al. | |
| 8,056,234 | B2 | 11/2011 | Calcei | |
| 8,057,120 | B2 | 11/2011 | Wernlund et al. | |
| 8,474,400 | B2 | 7/2013 | McGlinchy | |
| 8,652,382 | B2 | 2/2014 | Eggert et al. | |
| 8,720,026 | B2 | 5/2014 | McGlinchy | |
| 8,904,611 | B2 | 12/2014 | Calcei | |
| 9,212,515 | B2 | 12/2015 | Calcel | |
| 9,428,953 | B2 | 8/2016 | Briese et al. | |
| 2005/0168954 | A1 * | 8/2005 | Kim | G02F 1/133308 361/725 |
| 2006/0075719 | A1 | 4/2006 | James et al. | |
| 2007/0261795 | A1 | 11/2007 | Rosskamp | |
| 2010/0164859 | A1 * | 7/2010 | Huang | B21D 53/74 345/102 |
| 2011/0027606 | A1 | 2/2011 | Lenhardt | |
| 2012/0137608 | A1 | 6/2012 | Plant et al. | |
| 2013/0051902 | A1 | 2/2013 | Kelley et al. | |
| 2014/0029170 | A1 * | 1/2014 | Hsiao | B21D 53/74 361/679.01 |
| 2014/0124979 | A1 | 5/2014 | Eggert et al. | |
| 2014/0260491 | A1 | 9/2014 | Briese et al. | |
| 2015/0118951 | A1 * | 4/2015 | Beneke | F24F 13/20 454/330 |
| 2016/0258205 | A1 | 9/2016 | Oquendo | |

OTHER PUBLICATIONS

One (1) page Technical Service Bulletin published by Cardinal IG in May 2008 entitled Insulating Glass Durability.

One (1) page photograph of a box spacer frame having a connection located from a corner using a key insert, the box spacer frame shown in the photograph was on sale more than one year prior to the filing date of the subject application, namely Jun. 12, 2013.

English Translation of Foreign Patent Document No. DE 102004027527 A1, Published on Aug. 18, 2005, Patentee, Karl Lenhardt. Equivalent of WO2005/075783A1 (29 pages).

Office Action is Canadian Application No. 2,950,407 dated Sep. 15, 2017, (3 pages).

Supplementary European Search Report and Examiner's Report for EP15806949.2, dated Dec. 22, 2017 (8 pages).

Written Opinion of the International Searching Authority for PCT Application No. PCT/US2016/020437, dated Jul. 28, 2016 (14 pages).

International Search Report and Written Opinion of the International Searching Authority dated Jan. 30, 2018 for PCT International Application No. PCT/US2017/054396, filed Sep. 29, 2017. PCT International Application No. PCT/US2017/054396 corresponds to and claims priority from the present application. (9 pages).

* cited by examiner

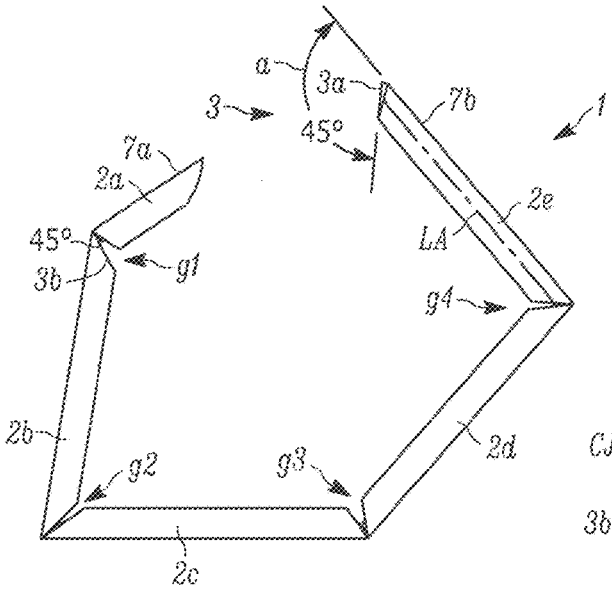
FIG. 1A
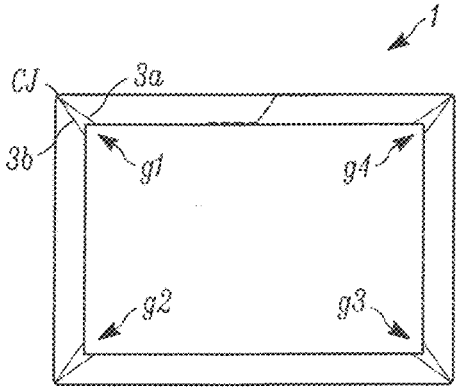
FIG. 1B
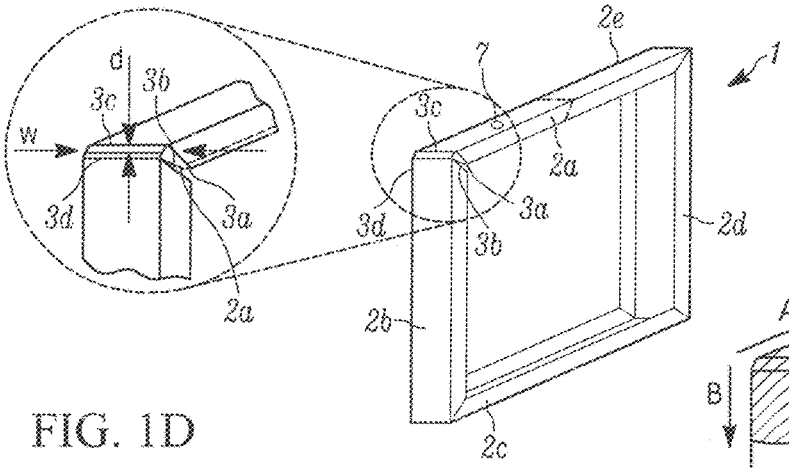
FIG. 1D
FIG. 1C
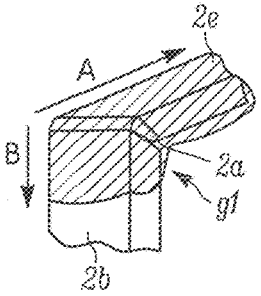
FIG. 1E

TACTILE SPACER FRAME ASSEMBLY AND LOCKING MEMBER

CROSS REFERENCES TO RELATED APPLICATIONS

The present application claims priority under 35 U.S.C. § 119(e) to U.S. Provisional Patent Application Ser. No. 62/402,312 filed Sep. 30, 2016 entitled TACTILE RESPONSIVE SPACER FRAME ASSEMBLY AND LOCKING MEMBER. The above-identified application is incorporated herein by reference in its entirety for all purposes.

FIELD OF DISCLOSURE

The present disclosure relates to a spacer frame and method of making same, and more specifically, a spacer frame and fabrication process for use with an insulating glass unit ("IGU").

BACKGROUND

Insulating glass units ("IGUs") are used in windows to reduce heat loss from building interiors during cold weather. IGUs are typically formed by a spacer assembly sandwiched between glass lites. A spacer assembly usually comprises a frame structure extending peripherally about the unit, a sealant material adhered both to the glass lites and the frame structure, and a desiccant for absorbing atmospheric moisture within the unit. The margins of the glass lites are flush with or extend slightly outwardly from the spacer assembly. The sealant extends continuously about the frame structure periphery and its opposite sides so that the space within the IGUs is hermetic.

There have been numerous proposals for constructing IGUs. One type of IGU was constructed from an elongated corrugated sheet metal strip-like frame embedded in a body of hot melt or sealant material. Desiccant was also embedded in the sealant. The resulting composite spacer was packaged for transport and storage by coiling it into drum-like containers. When fabricating an IGU, the composite spacer was partially uncoiled and cut to length. The spacer was then bent into a rectangular shape and sandwiched between conforming glass lites.

Another IGU construction has employed tubular, roll formed aluminum or steel frame elements connected at their ends to form a square or rectangular spacer frame. The frame sides and corners were covered with sealant (e.g., butyl material, hot melt, reactive hot melt, or modified polyurethane) for securing the frame to the glass lites. The sealant provided a barrier between atmospheric air and the IGU interior, which blocked entry of atmospheric water vapor. Particulate desiccant deposited inside the tubular frame elements communicated with air trapped in the IGU interior to remove the entrapped airborne water vapor and thus preclude its condensation within the unit. Thus, after the water vapor entrapped in the IGU was removed internal condensation only occurred when the unit failed.

In some cases the sheet metal was roll formed into a continuous tube, with desiccant inserted, and fed to cutting stations where "V" shaped notches were cut in the tube at corner locations. The tube was then cut to length and bent into an appropriate frame shape. The continuous spacer frame, with an appropriate sealant in place, was then assembled in an IGU.

Alternatively, individual roll formed spacer frame tubes were cut to length and "corner keys" were inserted between adjacent frame element ends to form the corners. In some constructions, the corner keys were foldable so that the sealant could be extruded onto the frame sides as the frame moved linearly past a sealant extrusion station. The frame was then folded to a rectangular configuration with the sealant in place on the opposite sides. The spacer assembly thus formed was placed between glass lites and the IGU assembly completed.

IGUs have failed because atmospheric water vapor infiltrated the sealant barrier. Infiltration tended to occur at the frame corners because the opposite frame sides were at least partly discontinuous there. For example, frames where the corners were formed by cutting "V" shaped notches at corner locations in a single long tube. The notches enabled bending the tube to form mitered corner joints; but afterwards potential infiltration paths extended along the corner parting lines substantially across the opposite frame faces at each corner.

Likewise in IGUs employing corner keys, potential infiltration paths were formed by the junctures of the keys and frame elements. Furthermore, when such frames were folded into their final forms with sealant applied, the amount of sealant at the frame corners tended to be less than the amount deposited along the frame sides. Reduced sealant at the frame corners tended to cause vapor leakage paths.

In all these proposals the frame elements bad to be cut to length in one way or another and, in the case of frames connected together by corner keys, the keys were installed before applying the sealant. These were all manual operations, which limited production rates. Accordingly, fabricating IGUs from these frames entailed generating appreciable amounts of scrap and performing inefficient manual operations.

In spacer frame constructions where the roll forming occurred immediately before the spacer assembly was completed, sawing, desiccant filling and frame element end plugging operations had to be performed by hand which greatly slowed production of units.

U.S. Pat. No. 5,361,476 to Leopold discloses a method and apparatus for making IGUs wherein a thin flat strip of sheet material is continuously formed into a channel shaped spacer frame having corner structures and end structures, the spacer thus formed is cut off, sealant and desiccant are applied and the assemblage is bent to form a spacer assembly. U.S. Pat. No. 5,361,476 is incorporated herein by reference in its entirety.

U.S. Pat. No. 7,448,246 to Briese et al. further describes the process of corner fabrication of a spacer frame. U.S. Pat. No. 8,720,026 to McGlinchy discusses additional methods of producing spacer frames. U.S. Pat. No. 9,428,953 to Briese et al. discusses methods of producing spacer frames as well as spacer frame assembly structures. U.S. Pat. Nos. 7,448,246, 8,720,026, and 9,428,953 are incorporated herein by reference in their entireties.

SUMMARY

One aspect of the disclosure comprises a spacer frame assembly and method of assembly that includes a substantially linear channel comprising two lateral walls and a base wall. The channel has first and second ends that when assembled, includes at least three sides and corresponding corners between each of said sides. The first end includes a connecting structure and the second end includes an opposite frame end. The opposite frame end has an opposite channel for receiving a nose portion of said connecting structure. The opposite channel includes stiffening flanges extending inwardly from the lateral walls relative to the channel. The connecting structure comprising a first aperture in the base wall of one of said nose portion and said receiving portion and a second aperture in the base wall of the other of said nose portion and said receiving portion and a projection bordering a second aperture wherein, the projection tactilely interweaves with the first aperture when assembled.

In another aspect of the present disclosure is a locking member for connecting together a nose member inserted within an overlying member of a spacer frame assembly. The locking member extends through aligned first and second apertures of the nose member and the overlying member. The locking member includes a head portion having a substantially planar top portion and a bottom portion. A shaft is coupled to the bottom portion of the head portion. A first flex arm extends from a first connection region of the shaft. The first flex arm has a first upright that defines a first ledge extending transversely from the first upright. The first flex arm pivots about the first connection region from an un-flexed position toward the shaft as the first flex arm contacts a periphery of the aligned first and second apertures of the spacer assembly. A second flex arm extends from a second connection region of the shaft. The second flex arm has a second upright that defines a second ledge extending transversely from the second upright. The second flex arm pivots about the second connection region toward the shaft from the un-flexed position and toward the shaft as the second flex arm contacts a periphery of the aligned first and second apertures of the spacer assembly. The first planar surface of the first flex arm and the second planar surface of the second flex arm are a latching distance from the bottom surface of the head portion. This latching distance is based upon a distance from an exposed surface of the overlying member to an innermost portion of the nose member in proximity to or bordered by the aperture that passes through the nose member.

In yet another aspect of the disclosure comprises a locking member for use in an aperture of a spacer frame assembly. The locking member comprises a head portion having a substantially plainer top portion and a bottom portion coupled to a shaft. The head portion comprises a head diameter greater than a shaft diameter of the shaft. The shaft extends orthogonally from the head along a longitudinal axis. The shaft comprises a through-bore defined by sidewalls of the shaft. The through-bore extends from the head portion through the shaft along the longitudinal axis. The shaft also includes a cross-bore through the sidewalls of the shaft along a lateral axis that intersects and is perpendicular to the longitudinal axis. The cross-bore defines a first opening and a second opening in the sidewalls, where the first opening is opposite the second opening along the lateral axis. The shaft further includes a first flex arm extending from a first connection region of the shaft. The first connection region partially defines the first opening. The first flex arm further includes a first upright comprising a first ledge extending transversely from the first upright. The first ledge terminates in a first planar surface parallel to the lateral axis, wherein the first flex arm pivots about the first connection region toward the longitudinal axis into the first opening from an un-flexed position and toward the lateral axis out of the first opening from a flexed position. The shaft additionally includes a second flex arm extending from a second connection region of the shaft. The second connection region partially defines the second opening. The second flex arm further includes a second uptight comprising a second ledge extending transversely from the second upright. The second ledge terminates in a second planar surface parallel to the lateral axis that in conjunction with the first ledge and the head portion functions as a latch for latching two or more objects together. Wherein the second flex arm pivots about the second connection region toward the longitudinal axis into the second opening from the un-flexed position and toward the lateral axis out of the second opening from the flexed position. Further, the first planar surface of the first flex arm and the second planar surface of the second flex arm are a latching distance from the bottom surface of the head portion. The latching distance is based upon a thickness of the two or more objects that the locking member latches together. The locking member consists of at least one of nylon, thermo-plastic, and stainless steel.

Another aspect of the disclosure comprises a spacer frame assembly comprising a substantially linear channel comprising two lateral walls and a base wall. The channel has first and second ends that when assembled, includes at least three sides and corresponding corners between each of said sides. The spacer frame further includes a connecting structure located on a first portion of the first end and an opposite frame end located on a second portion of said second end. The opposite frame end has an opposite channel for receiving a nose portion of said connecting structure. The opposite channel further comprises stiffening flanges extending inwardly from the lateral walls relative to the channel. The connecting structure additionally comprises a first aperture in the base wall and the opposite channel comprises a second aperture in the base wall. The second aperture comprises a second projection into the channel. The second projection tactilely interweaves with the first aperture when assembled. A locking member is housed by the first and second aperture when assembled. The locking member comprises a substantially flat head portion coupled to a shaft. The shaft comprises a latching structure that functions as a latch for latching the connecting structure to the opposite channel.

In yet another aspect of the disclosure a spacer frame assembly comprises a substantially linear channel comprising two lateral walls and a base wall. The channel has first and second ends that when assembled, includes at least three sides and corresponding corners between each of said sides. The spacer assembly also includes a connecting structure located on a first portion of the first end and an opposite frame end located on a second portion of said second end. The opposite frame end has an opposite channel for receiving a nose portion of said connecting structure. The opposite channel further comprises stiffening flanges extending inwardly from the lateral walls relative to the channel. The connecting structure comprises a first tactile portion and the opposite channel comprises a second tactile portion. The first tactile portion provides a frictional connection with the second tactile portion when assembled.

In yet another aspect of the disclosure a method of making a spacer frame assembly for bending into a multi-sided window or door spacer frame comprises providing a supply of narrow metal strip coiled on a support, unwinding the metal strip from the support to provide an elongated metal strip and moving the elongated metal strip along a path of travel to a stamping station, and stamping the strip at spaced apart corner locations by removing portions of said strip at said corner locations wherein inter-fitting leading and trailing ends of the spacer frame assembly are defined by a leading portion of said strip spaced from a first corner location and a trailing portion of said strip spaced from a second corner location. The method further includes stamping the leading portion of said strip to form a first aperture in the base wall and to form a nose, and stamping said trailing portion to form a second aperture and a second projection in the base wall. The second projection projecting into the channel, wherein the second projection tactilely interweaves with the first aperture when assembled, the nose extends into said trailing end when assembled. The method additionally includes roll forming the strip to form a channel shaped structure having lateral walls that include stiffening flanges projecting from the lateral walls of the trailing portion and severing the frame assembly from the elongated metal strip.

BRIEF DESCRIPTION OF THE SEVERAL VIEWS OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which:

FIG. 1A is an elevation construction view of a spacer frame constructed in accordance with one example embodiment of the present disclosure;

FIG. 1B is an elevation assembled view of the spacer frame of FIG. 1A;

FIG. 1C is a perspective assembled view of the spacer frame of FIG. 1A;

FIG. 1D is a magnified view of the assembled view of a portion of the spacer frame of FIG. 1C;

FIG. 1E is a perspective assembled view of the spacer frame of FIG. 1A, illustrating a required application of sealant;

Figure 2:
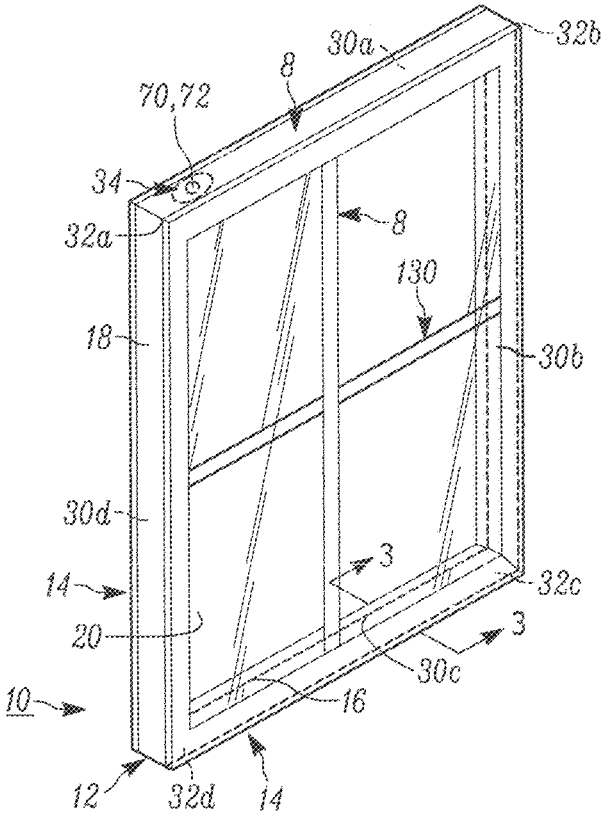
FIG. 2 is a perspective view of an insulating glass unit including glass lites.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements having similar characteristics and operational properties throughout unless otherwise noted. The present disclosure relates to a spacer frame and method of making same, and more specifically, a spacer frame and fabrication process for use with an insulating glass unit ("IGU").

The drawing figures and following specification disclose a method and apparatus for producing elongated window spacer frames 1 and 12 and window components 8 (see FIGS. 1A-1E and 2) used in IGUs 10. Examples of elongated window components include spacer frame assemblies 1, 12 and muntin bars 130 that form parts of the IGUs 10. The IGU components 8 are formed in one example embodiment from a production line, which forms sheet metal ribbon-like stock material into muntin bars and/or spacers carrying sealant and desiccant for completing the construction of IGUs. It should be appreciated that other materials, such as plastics, steel, and polymers, could be used to make the spacer frame 1 and/or 12 and the components 8.

Illustrated in FIGS. 1A-1E is first embodiment of a spacer frame 1 fabricated for IGUs. The spacer frame 1 is typically fabricated from an elongated metal strip and roll-formed into the orientation shown. The spacer frame 1 includes five different legs, 2*a*, 2*b*, 2*c*, 2*d*, and 2*e*. Leg 2*a* is a tab that when the spacer frame 1 is assembled is inserted into leg 2*e* to form a corner juncture or connection at CJ. Legs 2*b*-2*e* make up the four sides of the spacer frame 1. When the spacer frame 1 is bent from a linear strip into the four-sided frame (as illustrated by the transition from FIGS. 1A-1B) the leg 2*e* includes a chamfered end 3, typically as an angle $\alpha$ of 45 degrees from a longitudinal axis "LA" that extends along the center of leg 2*e*. This allows the tab leg 2*a* to be completely inserted into leg 2*e* until end sides 3*a* and 3*c* (see FIG. 1D) of the leg 2*e* bottom out on corresponding ends 3*b* and 3*d* to form corner juncture CJ. The insertion of the tab leg 2*a* into the leg 2*e* aligns apertures 7 in the tab leg and leg. Further discussion of the fabrication process of the spacer frame is discussed in U.S. Pat. No. 5,361,476 to Leopold, which is incorporated herein by reference in its entirety.

In the assembled position, the spacer frame 1 includes four gaps g1, g2, g3, and g4. The gap g1 is formed by the legs 2*a* and 2*b* and the passage the sliding of leg 2*e* over the leg 2*a* at end 3 of the corner juncture CJ. FIG. 1*e* illustrates the passage of hot melt or sealant 4 along directions A and B on the spacer frame 1 such that the corner juncture CJ is sealed along two directions, over the entire profile of the spacer frame.

Figure 2A:
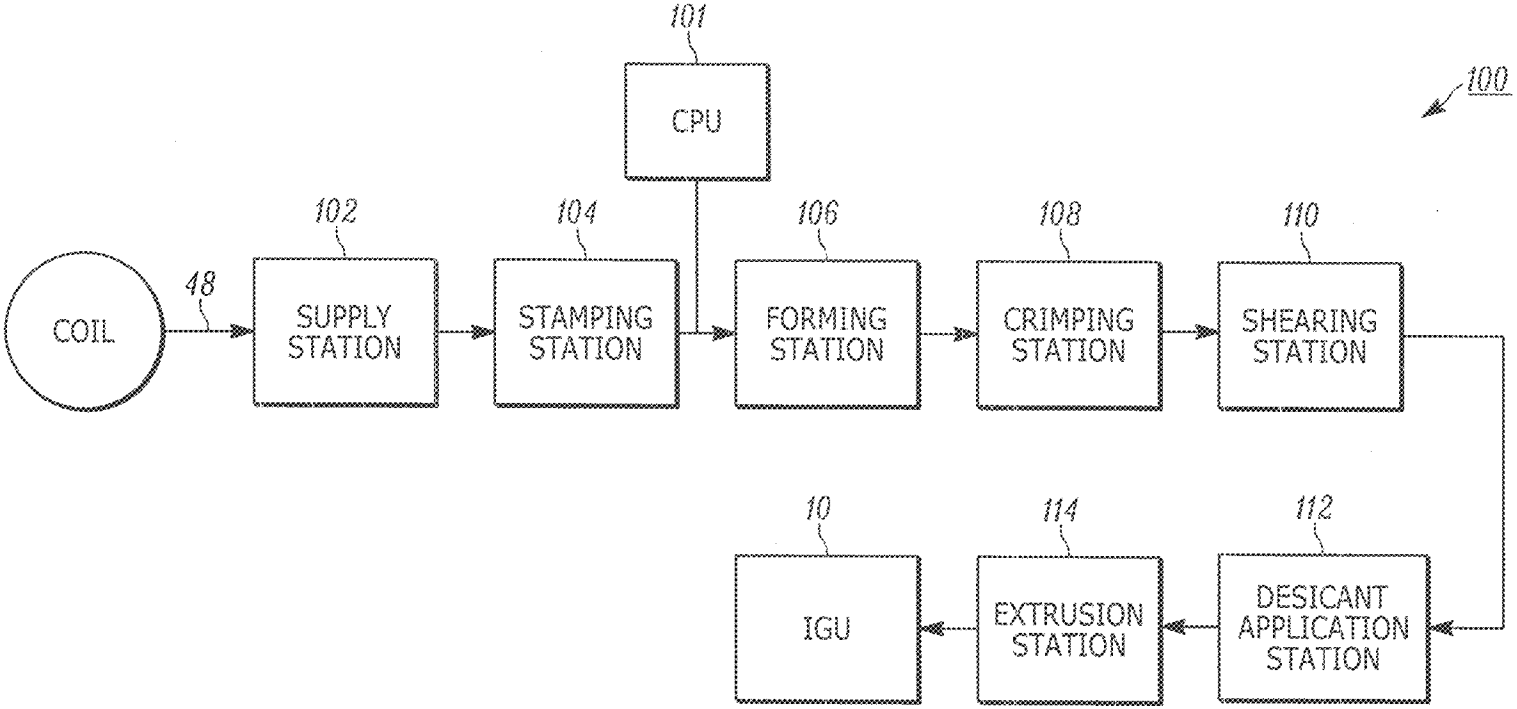
FIG. 2A is a schematic block diagram of a production line for manufacturing a spacer frame in accordance with one example embodiment of the present disclosure.

Illustrated in FIG. 2A is a schematic block diagram of a production line for manufacturing a spacer frame and insulating glass unit as further described in U.S. Pat. No. 7,610,681, which is incorporated herein by reference in its entirety. The production line 100 may be used to fabricate the insulating glass units 10 and spacer frame assemblies 1, 12 of the present disclosure. A stock strip 48 of material is fed endwise from a coil from a supply station into the production line 100 and substantially completed elongated window components 8 emerge from the other end of the line.

The production line 100 comprises a stock supply station 102, a stamping station 104 where various notches, hole indentations, apertures, projections, or lines of weaknesses, and tab profiles are punched into flat stock 48, a forming station 106 where the flat stock 48 is roll formed to make a u-shaped channel 33, a crimping station 108 where corners are bent and swaging is performed on the tab portion of the u-shaped channel, a shearing 110 station where the individual spacer frames are separated from the flat stock and cut to length and/or apertures and/or projections are stamped, a desiccant application station 112 where desiccant is applied between glass lites and the interior region formed by the lites and spacer frame assembly, and an extrusion station 114 where sealant is applied to the yet to be folded frame.

With reference to the operation of the stamping station 104, dies on opposite side of the strip 48 are driven into contact with the metal strip by an air actuated drive cylinder enclosed within the stamping station. In the illustrated embodiment, two air actuated cylinders drive a die support downward, moving spaced apart dies into engagement with the strip 48 to form the punch strip 36 (see FIG. 4A), which is backed by an anvil in the region of contact with the dies. In one example embodiment, a mandrel punches down through the strip 48 (see FIG. 4) to form apertures and punches into the strip to deform the strip to form projections. The projections are shaped based upon an imprint shape of the mandrel and the anvil region opposite the mandrel.

Due to the need to fabricate spacer frame assemblies 12 of different widths relative to the lateral walls, 42, 44, the dies are movable with respect to each other so that the region of contact between die and strip 48 is controlled. Similarly, when a connecting structure 34 comprising a nose portion or tab 34 of the spacer frame assembly 12 is formed, separate dies on opposite sides of the strip 48 engage the strip 36 at controlled locations to form the nose profile seen in FIG. 4A. When the width of the spacer frame between the lateral walls 42, 44 changes the relative position of lateral walls, the two dies are also adjusted. In the exemplary embodiment, stamping of the connecting structure 34 occurs at a separate time from stamping of the corners at the notches 50. Stated another way, the four corners 32 are formed by a first die set controlled by controller 101 that also controls each station of the production line 100 and the connecting structure 34 is formed at another time by a separated air cylinder drive that moves a separate die pair into contact with the strip 36. In one example embodiment, the separated air cylinder drive also forms apertures and/or projections. Coordination of these separate actuations is controlled by movement of the strip 36 through the stamping station 104 to appropriate positions for forming the corners and the connecting structure 34 of the spacer frame.

Figure 3:
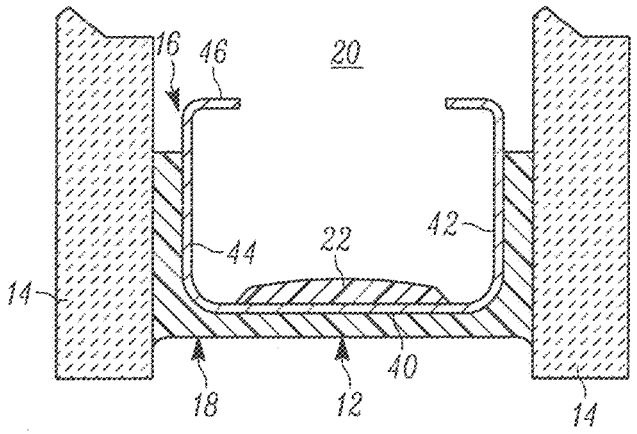
FIG. 3 is a cross sectional view seen approximately from the plane indicated by the line 3-3 of FIG. 2.

An insulating glass unit 10 illustrated in FIG. 2 is constructed using the method and apparatus further described in FIG. 2A as discussed above and in U.S. Pat. Nos. 8,720,026 and 7,448,246, which are both incorporated herein by reference in their entireties. In FIG. 2, the IGU 10 comprises a spacer frame assembly 12 sandwiched between glass sheets, or lites, 14. The spacer frame assembly 12 comprises a frame structure 16, sealant material 18 for hermetically joining the frame to the lites 14 to form a closed space 20 within the unit 10 and a body 22 of desiccant in the space 20, as illustrated in FIG. 3. The insulating glass unit 10 is illustrated in FIG. 2 as in condition for final assembly into a window or door frame, not illustrated, for ultimate installation in a building. The unit 10 illustrated in FIG. 2 includes muntin bars 130 that provide the appearance of individual window panes. The insulating glass unit with spacer frame 12 can be used with two spacer frames to form triple IGUs, i.e. with three glass lites as further describe in U.S. Pat. No. 9,416,583 that is assigned to the assignee of the present disclosure. U.S. Pat. No. 9,416,583 is incorporated herein by reference.

The assembly 12 maintains the lites 14 spaced apart from each other to produce the hermetic insulating "insulating air space" 20 between them. One of ordinary skill in the art would appreciate that the assembly 1, of FIGS. 1A-1E, or another assembly embodiment 10 could also be used to maintain the lites 14 spaced apart from each other. The frame structure 16 and the sealant body 18 co-act to provide a structure, which maintains the lites 14 properly assembled with the space 20 sealed from atmospheric moisture over long time periods during which the unit 10 is subjected to frequent significant thermal stresses. The desiccant body 22, as illustrated in the example embodiment of FIG. 3, removes water vapor from air, or other volatiles, entrapped in the space 20 during construction of the unit 10.

The sealant body 18 both structurally adheres the lites 14 to the spacer assembly 12 and hermetically closes the space 20 against infiltration of airborne water vapor from the atmosphere surrounding the unit 10. The illustrated body or sealant 18 is formed from a number of different possible materials, including for example, butyl material, hot melt, reactive hot melt, modified polyurethane sealant, and the like, which is attached to the frame sides and outer periphery to form a U-shaped cross section.

The spacer frame assembly 12 extends about the unit periphery to provide a structurally strong, stable spacer for maintaining the lites 14 aligned and spaced while minimizing heat conduction between the lites via the frame. In one example embodiment, the frame structure 16 comprises a plurality of spacer frame segments, or members, 30*a*-30*d* connected to form a planar, polygonal frame shape, element juncture forming frame corner structures 32*a*-32*d*, and the connecting structure 34 for joining opposite frame element ends or tail 30*d* to complete the closed frame shape (see FIG. 6).

Each frame member 30 is elongated and has a channel shaped cross section defining a peripheral wall 40 and first and second lateral walls 42, 44. See FIGS. 2, 3, 4B, 4C, 5, and 6. The peripheral wall 40 extends continuously about the unit 10 except where the connecting structure 34 joins the frame member end 30*d*. The lateral walls 42, 44 are integral with respective opposite peripheral or base wall 40 edges. The lateral walls 42, 44 extend inwardly to form a channel 33 with the peripheral wall 40 in a direction parallel to the planes of the lites 14 and the frame structure 16. The illustrated frame structure 16 has stiffening flanges 46 formed along the inwardly projecting lateral wall 42, 44 edges. The lateral walls 42, 44 add rigidity to the frame member 30 so it resists flexure and bending in a direction transverse to its longitudinal extent. The flanges 46 stiffen the lateral walls 42, 44 further so they have an increased resistance to bending and flexure transverse to their longitudinal extents.

Figure 4A:
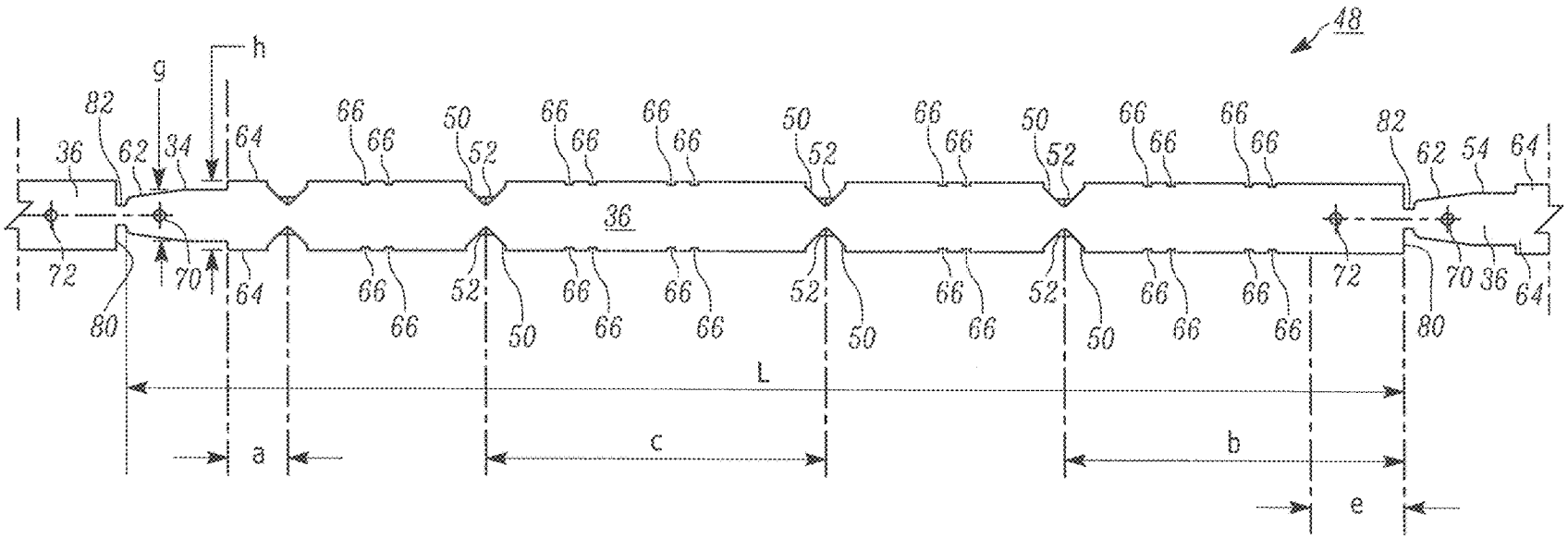
FIG. 4A is a plan view of flat stock after a punching operation that will be formed into one or more spacer frame assemblies before the flat stock is roll formed or has sealant applied.

In the illustrated example of FIG. 4A, the frame assembly 12 is initially formed as a continuous straight channel 33 constructed from a thin ribbon of metal or flat stock 48. One example of suitable metal includes stainless steel material having a thickness of 0.006-0.010 inches. Other materials, such as galvanized, tin plated steel, or aluminum, plastic, or foam can also be used to construct the channel 33 without departing from the spirit and scope of the present disclosure.

Illustrated in FIG. 4A is the continuous metal ribbon or flat stock 48 after it is passed through a stamping station and punched by a number of dies to form notches 50 and weakening zones 52 for corner folds 32, clip notches 66 (used in securing muntin bars), connecting structure 34, a nose 62, gas fill apertures 70, 72, projections 71, 77, (see, for example, FIGS. 8, 9) and end cut 80. A punch strip 36 of flat stock forms a single spacer frame assembly 12 as illustrated in repeating sections by dimension "L" from the continuous strip 48. The punch strip 36 is eventually sheared to make a spacer frame assembly 12 at end 80 and the nose 62, leaving scrap piece 82. Alternatively, the punching or shearing operation is a single hit operation in which the width of the shear equals that of scrap piece 82, leaving no scrap or need for a double hit operation. Further discussion relating to the shearing or punching operation is discussed in U.S. Pat. No. 8,720,026, which is incorporated herein by reference. The gas fill apertures 70, 72 comprise holes punched into the metal strip 48. The gas fill apertures 70, 72 are used to either inject the space 20 in the assembly 10 with a liquid and/or solid, or to evacuate the space.

The connecting structure 34 and stops 64 are formed by stamping dies at a stamping station 104 as described above. Shown in FIG. 4A, by dimension "g" in one example embodiment is a width of the connecting structure 34, which is smaller than the width of the stop 64 illustrated by dimension "h". In one example embodiment, the width of the connecting structure 34 shown by dimension "g" is one inch 1.00" and the width of the stops 64 shown by dimension "h" is one and three sixteenths of one inch 1.187". Thus, the difference between the width of the connecting structure 34 and stops 64 of the above example embodiment is approximately ninety-three thousands 0.093" of one inch from the outside edge of the strip 48 to an outside edge of the connecting structure.

Clip notches 66 are formed to support flexible clips that reside within the spacer frame assembly 12 and IGU once assembled. The flexible clips are used to support, for example, muntin bars as further discussed in U.S. Pat. No. 5,678,377, which is incorporated herein by reference. Notches 50 and weakening zones 52 are punched and crimped into the continuous strip 48, allowing for the formation of the corner structures 32. Further discussion of the punching and crimping operations is discussed in U.S. Pat. No. 7,448,246, which is incorporated by reference.

Figure 4B:
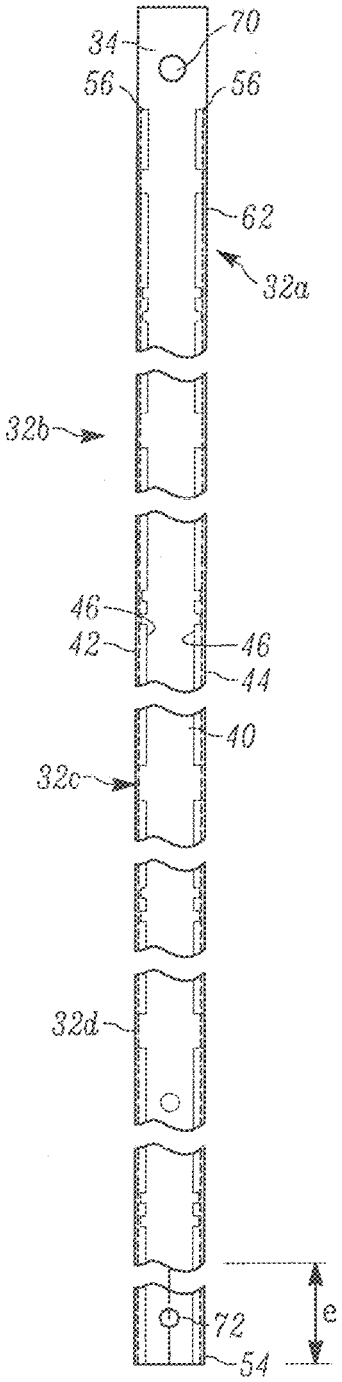
FIG. 4B is a plan view of the spacer frame assembly of FIG. 4A after a roll forming operation in an unfolded condition.
Figure 4C:
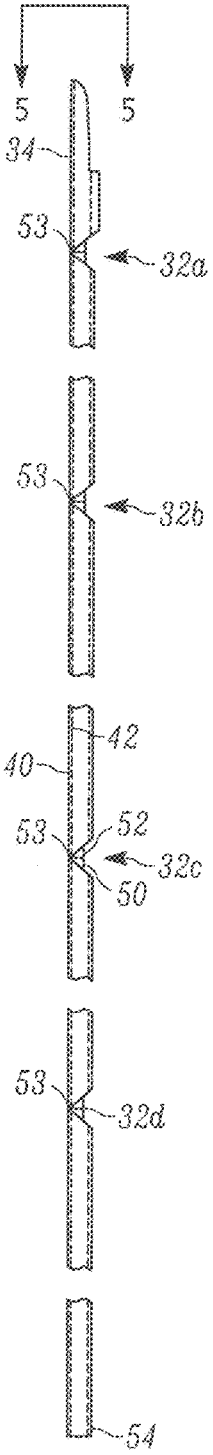
FIG. 4C is side elevation view of the spacer frame assembly of FIG. 4B.
Figure 5:
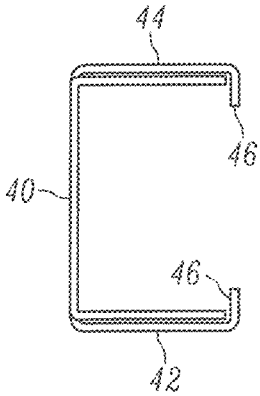
FIG. 5 is an enlarged elevation view seen approximately from the plane indicated by the line 5-5 of FIG. 4C.

Before the punch strip 36 is sheared from the continuous strip 48, it is roll formed to the configuration illustrated in FIGS. 4B, 4C, and 5, creating peripheral wall 40, lateral walls 42, 44, and stiffening flanges 46. In one example embodiment, the projections 71, 77, (see, for example, FIGS. 8A-B, 9A-B) are formed, as described above, after the roll forming operation. Further discussion as to the roll forming operation is discussed in U.S. Pat. No. 8,904,611, which is incorporated herein by reference.

Figure 6:
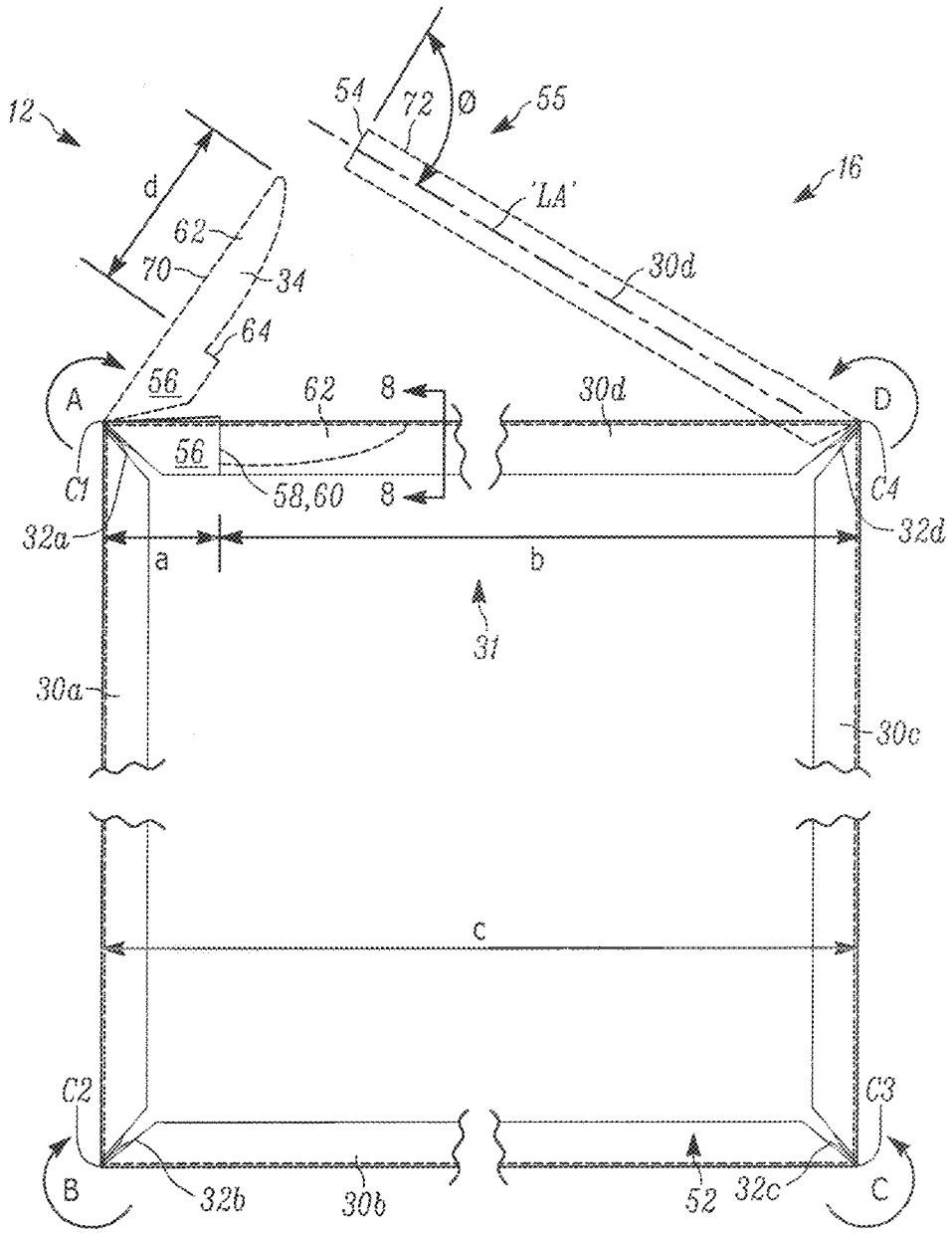
FIG. 6 is a fragmentary elevation view of a spacer frame forming part of the unit of FIG. 2 which is illustrated in a partially constructed condition.
Figure 7:
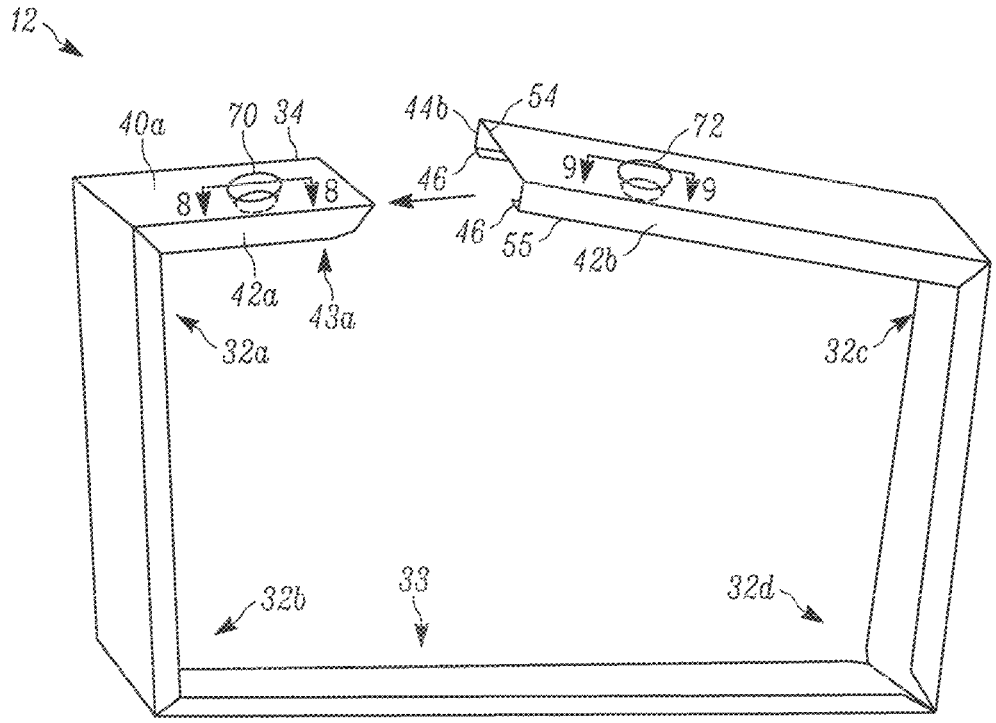
FIG. 7 is a perspective view of a spacer frame assembly in accordance with one example embodiment of the present disclosure.

The corner structures 32 are formed to facilitate bending the frame channel to the final, polygonal frame configuration in the unit 10 while assuring an effective vapor seal at the frame corners, as seen in FIGS. 2 and 6. The sealant body 18 is applied and adhered to the channel 33 before the corners are bent. The corner structures 32 initially comprise notches 50 and weakened zones 52 formed in the walls 42, 44 at frame corner locations. See FIGS. 3, 4A-4C. The notches 50 extend into the lateral walls 42, 44 from the respective lateral wall edges. The lateral walls 42, 44 extend continuously along the frame 12 from one end to the other. The lateral walls 42, 44 are weakened at the corner locations because the notches 50 reduce the amount of lateral wall material and eliminate the stiffening flanges 46 and because the lateral walls are stamped to form a line of weakness 53 (see FIG. 4C) to weaken them at the corners 32*a*-32*d* and thus allow inward flexing as the spacer frame assembly 12 is bent.

The connecting structure 34 is inserted into an opposite frame end 54 or leg member 30*d* when the spacer frame assembly 12 has been bent to its final configuration. That is, rotating the linear spacer frame assembly 12 segments or members 30 (from the linear configuration of FIGS. 4B and 5) in the direction of arrows A, B, C, and D as illustrated in FIG. 6 and particularly, inserting a nose 62 of the connecting structure 34 into the opposite channel 55 formed at the opposite end 54 of segment 30*d* with concomitant rotation of the segments (arrows A-D). This concomitant rotation continues until the connecting structure 34 slides into the opposite channel 55 of segment 30*d* at the opposite end 54. In the illustrated example embodiment of FIG. 6, the opposite end 54 engages positive stops 64 in the connecting structure 34 forming a telescopic union 58 and lateral connection 60 to make a compound lateral leg 31.

The telescopic union 58 and lateral connection 60 are formed along the lateral leg 31 and spaced from the corner structures 32, which in the illustrated example embodiment of FIG. 6 is C1. When assembled, the telescopic union 58 maintains the frame 12 in its final polygonal configuration prior to assembly of the insulating glass unit 10. As in the illustrated example embodiment of FIG. 6, the compound lateral leg 31 has a length of dimensions "a" (first frame end 56 from the corner C1 to the end of the stop 64) plus "b" (the fourth frame segment or member 30*d*), which equals the length of dimension "c" (see FIG. 6), the length of a second and opposite side segment 30*b*. Dimension "b" in the illustrated example embodiment, is the length of segment 30*d* and dimension "a" is the length of the connecting structure 34 less the length of the nose 62 (dimension d) that is inserted into the opposite channel 55 formed in segment 30*d*.

In the illustrated example embodiments, the connector structure 34 further comprises a first gas fill aperture 7*a*, 70 and corresponding second gas fill aperture 7*b*, 72 in the segment 30*d* for housing a locking member 202, 302 (see FIGS. 1A, 20-37). The locking members 202, 302 connects the opposite channel 55 comprising the opposite frame end 54 with the connecting structure 34. While the gas fill apertures 7*a*, 70, 7*b*, 72 provide a temporary vent for the evacuation of air or insertion of gas into the space 20 while the unit 10 is being fabricated.

In the illustrated example embodiment of FIGS. 7-12, a first projection 71 defined by the first gas fill aperture 70 is formed through the base wall 40*a* into the channel 33 and a second projection 75 defined by said second gas fill aperture 72 is formed in the base wall into the channel, wherein the first projection interweaves (see FIG. 11) with the second projection when assembled. The interweaving provides a friction connection 69. Stated another way second projection 75 nests with, or is seated within the first projection 71 to comprise the friction connection 69. The friction connection 69 is a responsive tactile connection, in that it provides to the assembler feedback if there is over-travel or under-travel when advancing one or both of the connecting structure 34 and the opposite channel 55 towards each other. That is, the friction during assembly remains high during under-travel until the interweaving of the projections 71, 75 is achieved to form the friction or responsive tactile connection 69. Once the interweaving is achieved, the friction significantly diminishes between the base wall 40*a* and the second projection 75. Similarly, if over-travel from the tactile connection 69 occurs, the friction significantly increases. This tactile response occurs because the second projection 75 rubs the base wall 40*a* (see FIGS. 10-11) of the connecting structure 34, until the tactile connection 69 is reached between the first and second projections 71, 75.

The apertures 70 and 72 are aligned because of the interweaving connection 69 of the first projection 71 and the second projection 75. The interweaving feature 69 reassures concentric alignment of the apertures 70, 72. Additionally, the concentric alignment of the gas fill apertures 70, 72 is further assured by one of the interaction of end 3*a* engaging the corner gap g1 at the corner juncture CJ, as illustrated in FIG. 1B, or the interaction of the opposite frame end 54 with the stop 64, as illustrated in FIG. 6, when such structures are present. Advantageously, the concentric alignment of the gas fill apertures 70, 72 is reassured based on the frictional tactile feedback connection 69 provided during assembly to the assembler, as described above, even without the telescopic union 58, or the lateral connection 60, as illustrated in FIG. 6, or even without engagement of the end 3*a* with the corner as illustrated in FIGS. 1A-1E.

Figure 8A:
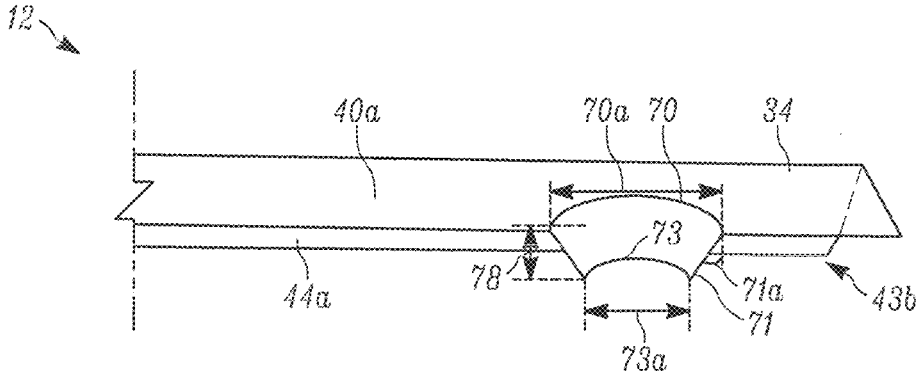
FIG. 8A is a perspective view of the spacer frame after sectioning along the line 8-8 of FIG. 7, illustrating one example embodiment of the present disclosure.
Figure 8B:
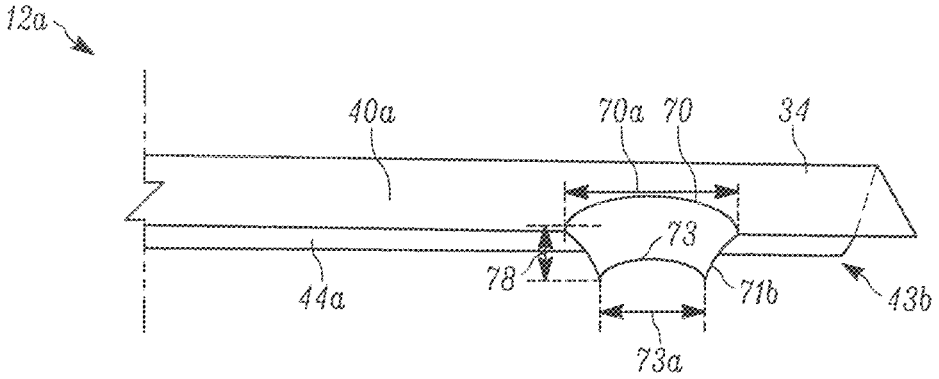
FIG. 8B is a perspective view of the spacer frame after sectioning along the line 8-8 of FIG. 7, illustrating another example embodiment of the present disclosure.
Figure 9A:
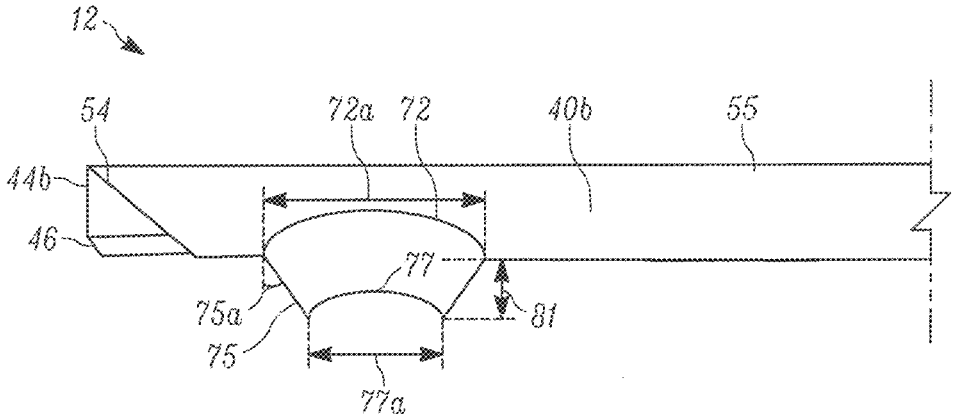
FIG. 9A is a perspective view of the spacer frame after sectioning along the line 9-9 of FIG. 7, illustrating the embodiment of FIG. 8A.
Figure 9B:
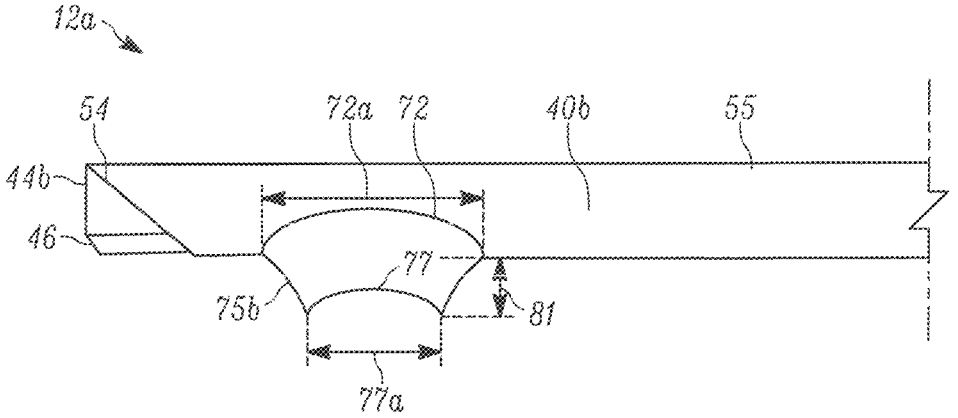
FIG. 9B is a perspective view of the spacer frame after sectioning along the line 9-9 of FIG. 7, illustrating the embodiment of FIG. 8B.

As seen in FIGS. 8A, 9A, the first projection 71 extends radially from the first aperture 70 into the channel 33 from a base wall 40*a* of the connecting structure 34. In one example embodiment, the first projection 71 extends into the channel 33 at a first projection angle 71*a*. Wherein, the first projection angle 71*a* is between 85° to about 5° relative to the base wall 40*a*. In another example embodiment, the first aperture 70 comprises a substantially circular opening having a first diameter 70*a* at the base wall 40*a* and a second diameter 73*a* at a most inwardly projecting point 73 of the first projection 71. In an example embodiment, the first diameter 71*a* is greater than the second diameter 73*a*. In another example embodiment, such as illustrated in FIGS. 8B, 9B, the first and second projections 71*a*, 75*a* resemble a funnel, a hyper-cone, or a truncated pseudo-sphere. Such geometrical shapes are formed when a punch engages the strip 48 causing both deformation and swage fracturing of the strip, such that the first diameter 70*a* is greater than the second diameter 73*a*, and the third diameter 72*a* is greater than the fourth diameter 77*a*.

In one example embodiment, the second projection 75 extends into the channel 33 at a second projection angle 75*a*. Wherein, the second projection angle 75*a* is between 85° to about 5° relative to the base wall 40*b*. In one example embodiment, the second aperture 72 comprises a substantially circular opening having a third diameter 72*a* at a base wall 40*b* of the opposite channel 55 and a fourth diameter 77*a* at a most inwardly projecting point 77 of the second projection 75. In another example embodiment, the first diameter 70*a* is equal to the third diameter 72*a*, and the second diameter 73*a* is equal to the fourth diameter 77*a*. In yet another example embodiment, the first and second diameters 70*a*, 73*a*, respectively, are larger than the third and fourth diameters 72*a*, 77*a*, respectively, to facilitate interweaving or nesting at the tactile connection 69. This different size is achieved, in one example embodiment, by different sized punch tools at either the stamping station 104 and/or at the crimping station 108.

In the illustrated example embodiment, the second projection 75 extends radially from the second aperture 72 into the channel 33 from the base wall 40*b* of the opposite channel 55. In another example embodiment, the first projection 71 extends a first distance 78 into the channel 33 from an interior surface of the base wall 40*a* and the second projection 75 extends a second distance 81 into the channel 33 from an interior surface 40*c* of the base wall 40*b*. In one example embodiment, the first distance 78 is substantially a same distance as the second distance 81.

Figure 10:
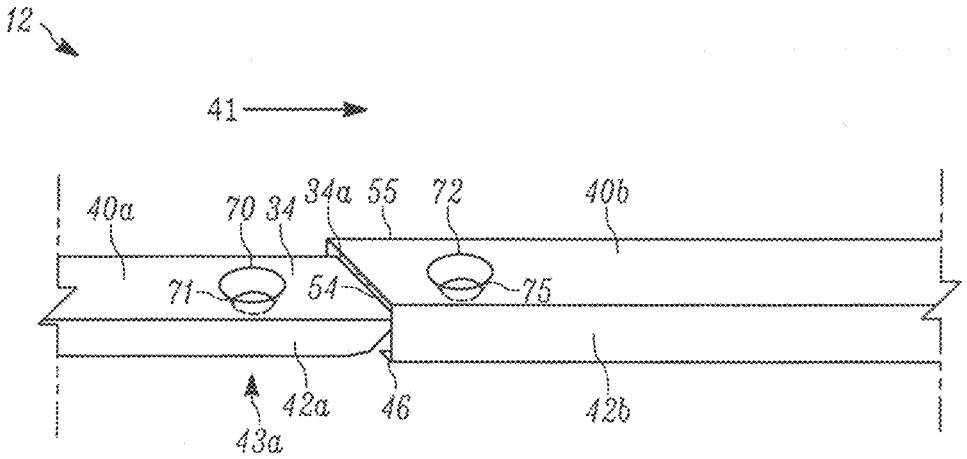
FIG. 10 is a perspective view of a section of a spacer frame assembly in a pre-assembled position in accordance with one example embodiment of the present disclosure.

In the illustrated example of FIG. 10, during assembly the connecting structure 34 is inserted 41 into the opposite channel 55. Upon initial insertion, edges 43*a*, 43*b* of the lateral walls 42*a*, 42*b* of the connecting structure 34 interact with the stiffening flanges 46 on the opposite channel 55 (see also FIG. 12). The interaction of the edges 43*a*, 43*b* with the stiffening flanges 46 creates an upward (e.g., toward the base wall 40*b* of the channel 33) force on the connecting structure 34. As a front edge 34*a* of the connecting structure 34 passes underneath the second projection 75, a top surface of the base wall 40*a* interacts with the most inwardly projecting point 77 of the second projection 75 and the edges 43*a*, 43*b* exert a force on the stiffening flanges 46, generating friction. In an example embodiments, responsive to the force exerted by the edges 43*a*, 43*b*, on the stiffening flanges 46, the lateral walls 42*b*, 44*b* flex outwardly, away from each other to accommodate the force and allow the connecting structure 34 to be inserted 41 into the opposite channel 55 (see FIG. 8A).

Figure 11:
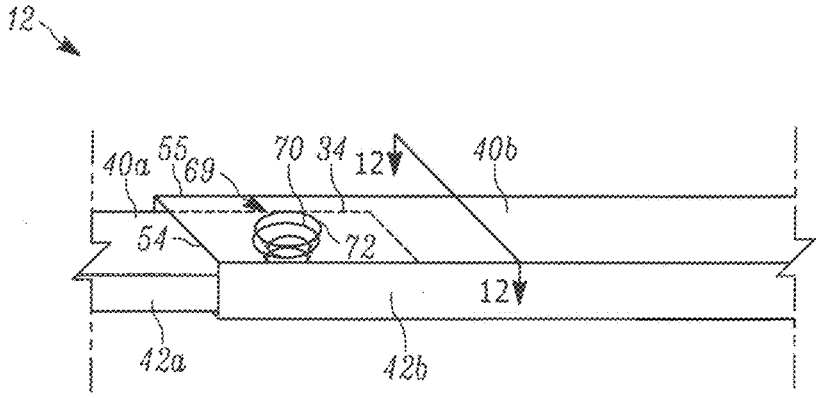
FIG. 11 is a perspective view of a section of a spacer frame assembly in an assembled position in accordance with one example embodiment of the present disclosure.

The connecting structure 34 is inserted into the opposite channel 55 until the first aperture 70 is concentrically aligned with the second aperture 72, as illustrated in FIG. 11. Once the first aperture 70 and the second aperture 72 are concentrically aligned the first projection 71 and the second projection 75 are interweavingly connected 69 based upon an upward force from the interaction of the edges 43*a*, 43*b* with the stiffening flanges 46, and the interaction of the first projection 71 with the second projections 75.

Figure 12A:
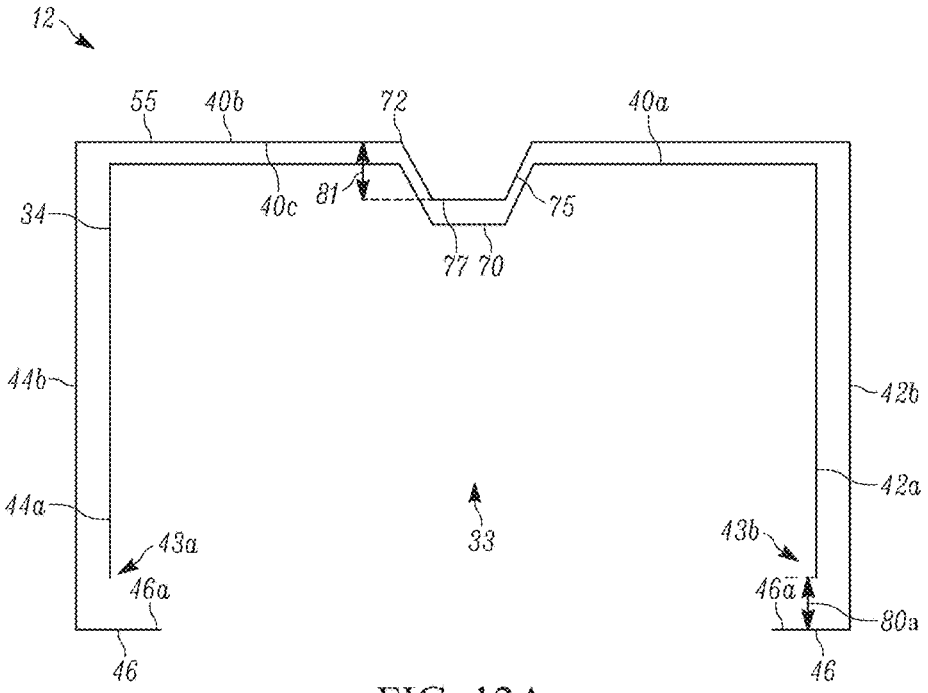
FIG. 12A is a schematic cross-section view taken along the line 12-12 of FIG. 11.
Figure 12B:
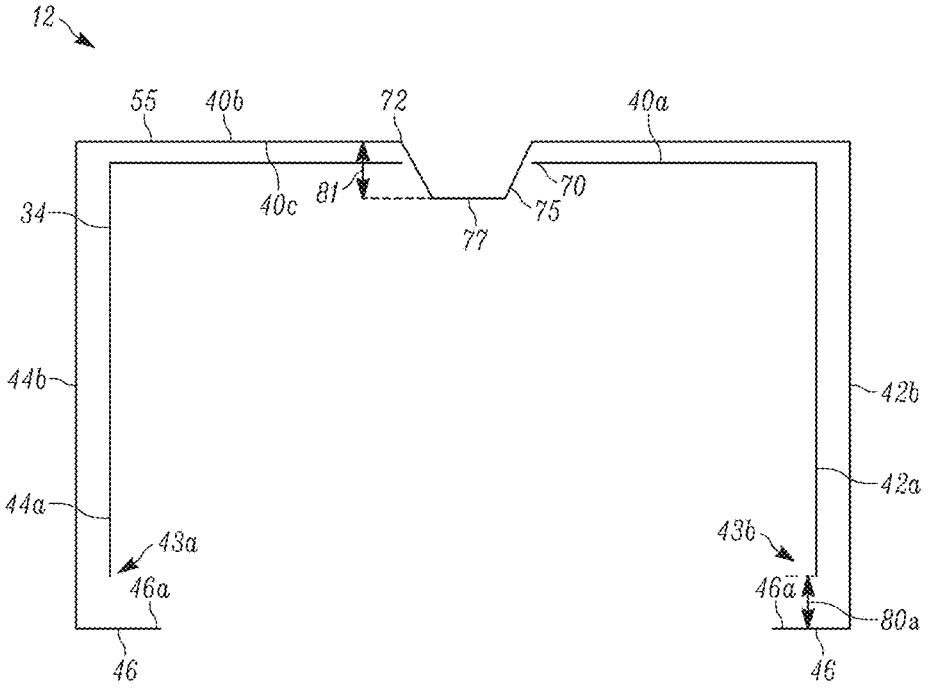
FIG. 12B is a schematic cross-section view taken along the line 12-12 of FIG. 11, wherein a single projection is present.

As in the illustrated embodiment of FIG. 12A, when assembled, a first distance 80*a*, comprising a distance between an inward facing face 46*a* of the stiffening flanges 46 and the edges 43*a*, 43*b* of the lateral walls 42*a*, 44*a*, is less than a second distance 81, thus imposing friction and/or the tactile connection 69 during assembly. The second distance 81 comprises a distance between the interior surface 40*c* of the base wall 40*b* of the opposite channel 55 and the most inwardly projecting point 77 of the second projection 75. Thus, the first and second projections 71, 75 are interwovenly engaged 69. In another example embodiment as illustrated in FIG. 12B, the first aperture 70 comprises the substantially circular opening but lacks the first projection 71, wherein the second projection 75 interweaves 69 with the first aperture 70.

The interweaving responsive connection 69 of the first and second projections 71, 75 insures that the apertures 70, 72 are consistently concentrically aligned, as well as insuring that that the corner structures 32*a*-32*d* are formed correctly (e.g., not over or under traveled to address an under-lap or overlap of the connecting structure 34 and the opposite frame end 54). Additionally, such as illustrated in the first embodiment of the spacer 16 in FIGS. 1A-1E, the interweaving connection 69 of the first and second projections 71, 75 insures that the end 3*a* engages the corner gap g1 at the corner juncture CJ correctly and accurately; thus, reducing failures at the corner junction CJ. This advantageously reassures that all four corner structures 32 are identical in spacing, size, and angle orientation, thus reducing the potential for failure. Further, the interweaving connection 69 reduces an incidence of accidental disassembly during the sealant and/or curing process. In yet another example embodiment, the first projection 71 is not present, and the second projection 75 interweaves or engages through the first aperture 70 (see FIG. 12B).

Turning to FIGS. 13-19A, and 19B, a second embodiment of the spacer assembly 112 comprising first and second apertures 170, 172 is illustrated. The spacer assembly 112, as illustrated in FIGS. 13-19A and 19B, is substantially similar to the spacer assembly 12 as illustrated in FIGS. 7-12 with shared features being identified by the same numeral increased by a factor of 100. A primary change from the spacer assembly 12 is that the spacer assembly 112 comprises first and second apertures 170, 172 having projections comprising tabs 171*a*, 171*b*, 175*a*, 175*b* rather than projections that extend radially around an entire circumference of the apertures.

Figure 13:
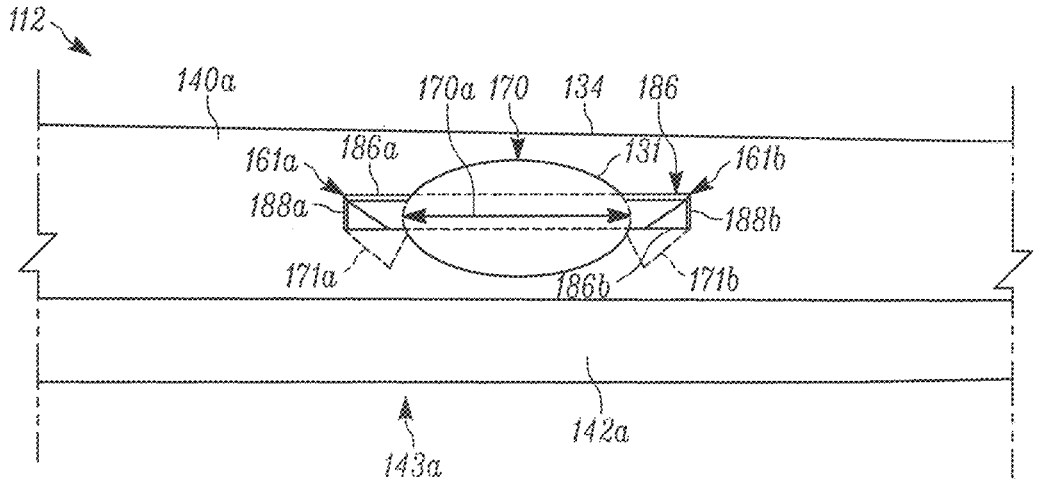
FIG. 13 is a perspective view of a section of a connecting structure of a spacer frame assembly in accordance with a second example embodiment of the present disclosure.

In the illustrated example embodiment of FIG. 13, the first aperture 170, disposed on the connecting structure 134, comprises a substantially circular opening having a peripheral edge 131. The peripheral edge 131 is interrupted by the first projection, comprising the first and second tabs 171*a*, 171*b*. The first tab 171*a* extends radially from a first interruption 161*a* in the peripheral edge 131 into the channel 133 from the base wall 140*a*. The second tab 171*b*, located opposite the first tab 171*b* relative to the peripheral edge 131, extends radially from a second interruption 161*b* into the channel 133 from the base wall 140*a*. In one example embodiment, the first and second tabs 171*a*, 171*b* extend into the channel 133 at a first tab angle between 85° to about 5° relative to the base wall 140*a*.

In another example embodiment, the first projection comprises the first and second tabs 171*a*, 171*b* and a rectangular indentation 186 overlaying the first aperture 170. The rectangular indentation 186 comprises a first longer side 186*a* parallel to a second longer side 186*b*. In the illustrated example embodiment of FIG. 13, the first and second longer sides 186*a*, 186*b* are connected by a first shorter side 188*a* and a second shorter side 188*b*, respectfully. In one example embodiment, the first shorter side 188*a* and the second shorter side 188*b* are orthogonal to the first longer side 186*a* and the second longer side 186*b*. In another example embodiment, the first shorter side 188*a* is parallel to the second shorter side 188*b*. In one example embodiment, the first and second longer sides 186*a*, 186*b* of the rectangular indentation 186 are greater than a diameter 170*a* of the aperture 170. In one example embodiment, the first and second tabs 171*a*, 171*b* extend radially from the first and second shorter sides 188*a*, 188*b* of the rectangle 186, respectively. In another example embodiment, the first and second longer sides 186*a*, 186*b* are parallel to the lateral walls 142*a*, 144*a*.

Figure 14:
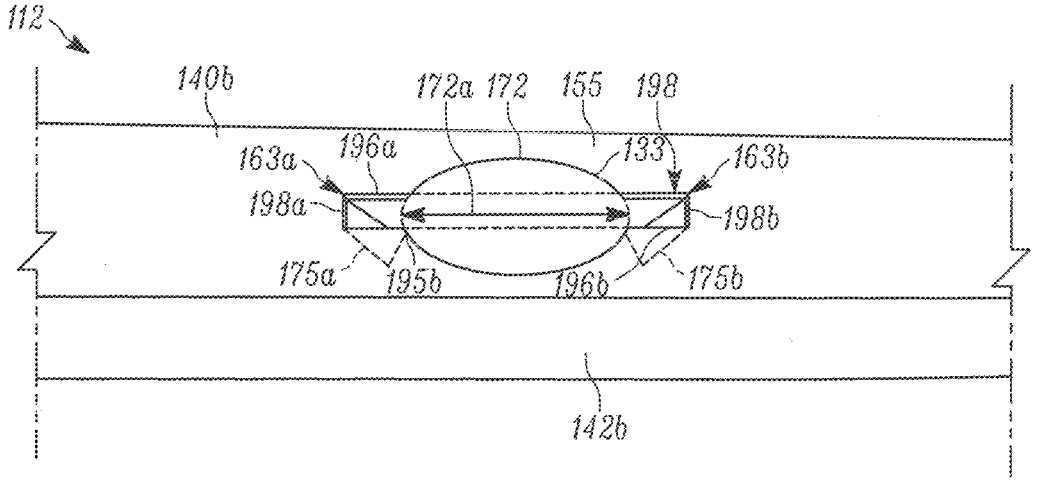
FIG. 14 is a perspective view of a section of an opposite frame end of a spacer frame assembly in accordance with a second example embodiment of the present disclosure.

In the illustrated example embodiment of FIG. 14, the second aperture 172, located on the opposite channel 155, comprises a substantially circular opening having a peripheral edge 133. It would be appreciated by one of ordinary skill in the art that the first and second apertures 170, 172 can comprise a multitude of geometric shapes, such as a square, a rectangle, a parallelogram, an ellipse, or the like. In one example embodiment, the peripheral edge 131 of the first aperture 170 is a same or similar size as the peripheral edge 133 of the second aperture 172. In one example embodiment, the peripheral edge 133 is interrupted by the second projection comprising a third tab 175*a* and a fourth tab 175*b*. The third tab 175*a* extends radially from a third interruption 163*a* in the peripheral edge 133 into the channel 133 from the base wall 140*b*. The fourth tab 175*b*, located opposite the third tab 175*a* relative to the peripheral edge 133, extends radially from a fourth interruption 163*b* into the channel 133 from the base wall 140*b*. In one example embodiment, third and fourth tabs 175*a*, 175*b* extend into the channel 133 at a second tab angle between 85° to about 5° relative to the base wall 140*b*.

In another example embodiment, the second projection on the opposite channel 155 comprises the third and fourth tabs 173*a*, 173*b* and a rectangular indentation 198 overlaying the second aperture 172. In one example embodiment, the rectangular indentation 198 comprises same or similar dimensions as the rectangular indentation 186 comprised in the first projection on the connecting structure 134. In another example embodiment, the rectangular indentation 198 at least partially interweavingly connects 69 with the rectangular indentation 186. The rectangular indentation 198 comprises a first longer side 196*a* parallel to a second longer side 196*b*.

Figure 17A:
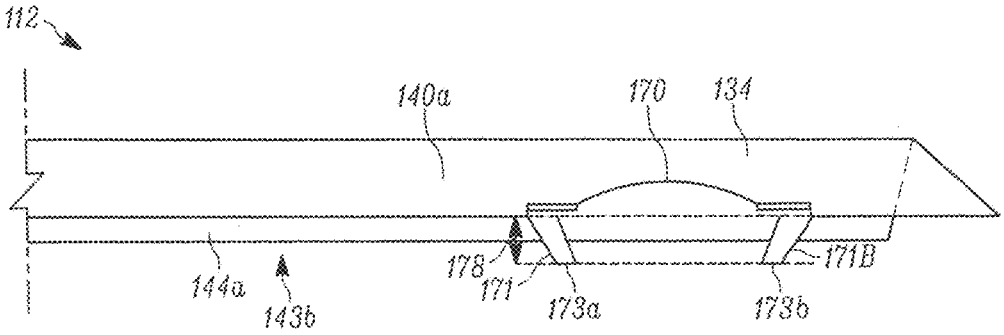
FIG. 17A is a perspective view of the spacer frame after sectioning along the line 17-17 of FIG. 15.
Figure 17B:
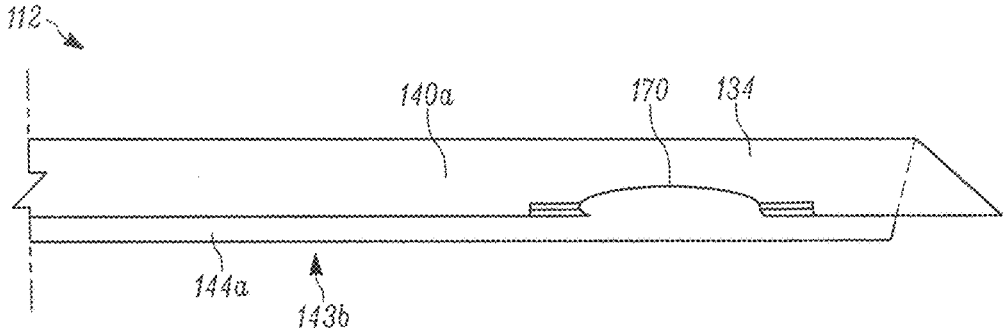
FIG. 17B is a perspective view of the spacer frame after sectioning along the line 17-17 of FIG. 15 wherein a single projection is present.
Figure 18:
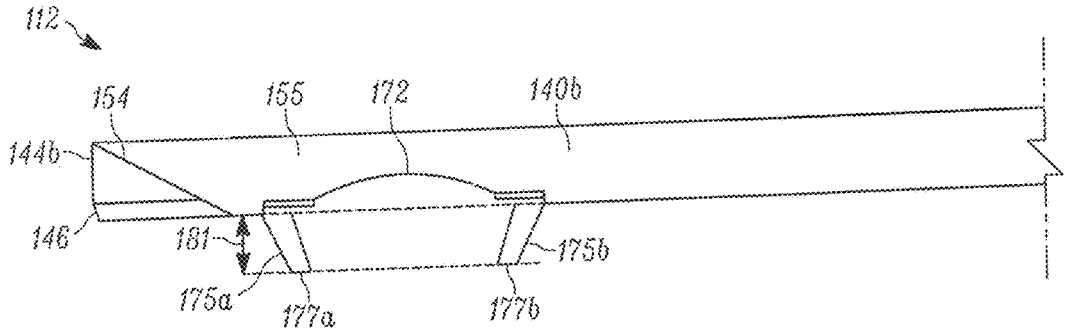
FIG. 18 is a perspective view of the spacer frame after sectioning along the line 18-18 of FIG. 15.

In the illustrated example embodiment of FIG. 14, the first and second longer sides 196*a*, 196*b* are connected by a first shorter side 198*a* and a second shorter side 198*b*, respectfully. In one example embodiment, the first and second longer sides 196*a*, 196*b* are connected orthogonally by the first shorter side 198*a*, the second shorter side 198*b*. In another example embodiment, the first shorter side 198*a* is parallel to the second shorter side 198*b*. In one example embodiment, the first and second longer sides 196*a*, 196*b* of the rectangle 198 are greater in length than a diameter 172*a* of the peripheral edge 133 of the aperture 172. In another example embodiment, the third and fourth tabs 175*a*, 175*b* extend radially from the first and second shorter sides 198*a*, 198*b* of the rectangle 198, respectively. In an example embodiment, the first and second longer sides 196*a*, 196*b* are parallel to the lateral walls 142*b*, 144*b*. In yet another example embodiment, as illustrated in FIGS. 17B and 19B, the first aperture 170 lacks the first and second tabs 171*a*, 171*b*, wherein the third and fourth tabs 175*a*, 175*b*, interweavingly connect 169 with the first and second shorter sides 188*a*, 188*b* and/or the interruption of the peripheral edge of the first aperture, in this example embodiment, the rectangular indentation 186 can be absent or present.

Figure 15:
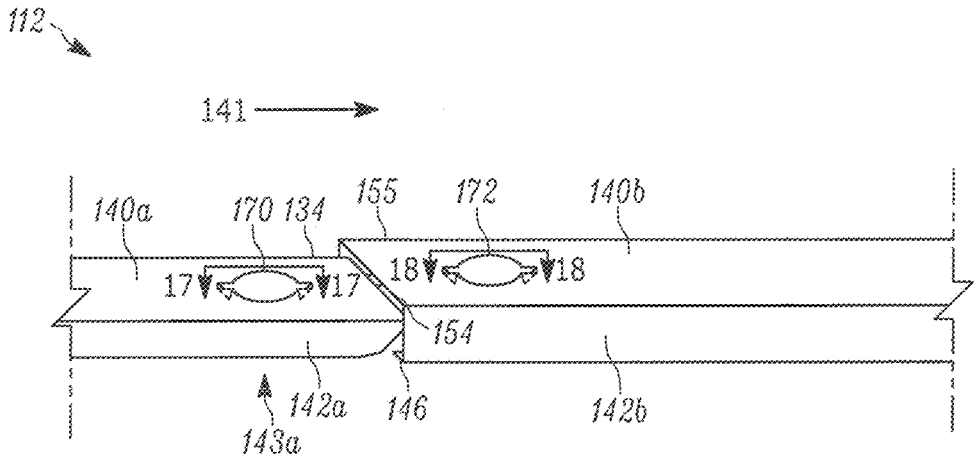
FIG. 15 is a perspective view of a section of a spacer frame assembly in a pre-assembled position in accordance with a second example embodiment of the present disclosure.
Figure 16:
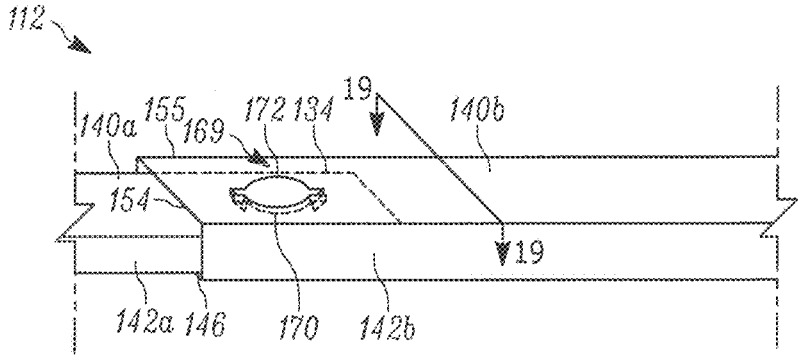
FIG. 16 is a perspective view of a section of a connecting structure of a spacer frame assembly in an assembled position in accordance with a second example embodiment of the present disclosure.

The illustrated example of FIGS. 15-16, during assembly, the connecting structure 134 is inserted 141 into the opposite channel 155, as described above with regard to FIG. 10. Wherein as a front edge 134*a* of the connecting structure 134 passes underneath the third and fourth tabs 175*a*, 175*b*, a top surface of the base wall 140*a* interacts with most inwardly projecting points 177*a*, 177*b* of the third and fourth tabs 175*a*, 175*b*, in the same manner as the most inwardly projecting point 77 of the second projection 75 in the first embodiment, illustrated in FIGS. 10-11.

As in the illustrated embodiments of FIGS. 16, 17A, 18, and 19A, the connecting structure 134 is inserted into the opposite channel 155 until the first aperture 170 is concentrically aligned with the second aperture 172. Once the first aperture 170 and the second aperture 172 are concentrically aligned, the first and second tabs 171*a*, 171*b* and the third and fourth tabs 175*a*, 175*b* are interwovenly engaged to form the tactile connection 169 based upon an upward force from the interaction of edges 143*a*, 143*b* with the stiffening flanges 146, and the interaction of the first and second tabs 171*a*, 171*b* with the third and fourth tabs 175*a*, 175*b*. In another embodiment, third and fourth tabs 175*a*, 175*b* are interwovenly engaged to form the tactile connection 169 based upon an upward force from the interaction of edges 143*a*, 143*b* with the stiffening flanges 146, and the interaction the third and fourth tabs 175*a*, 175*b* with the first aperture 170.

Figure 19A:
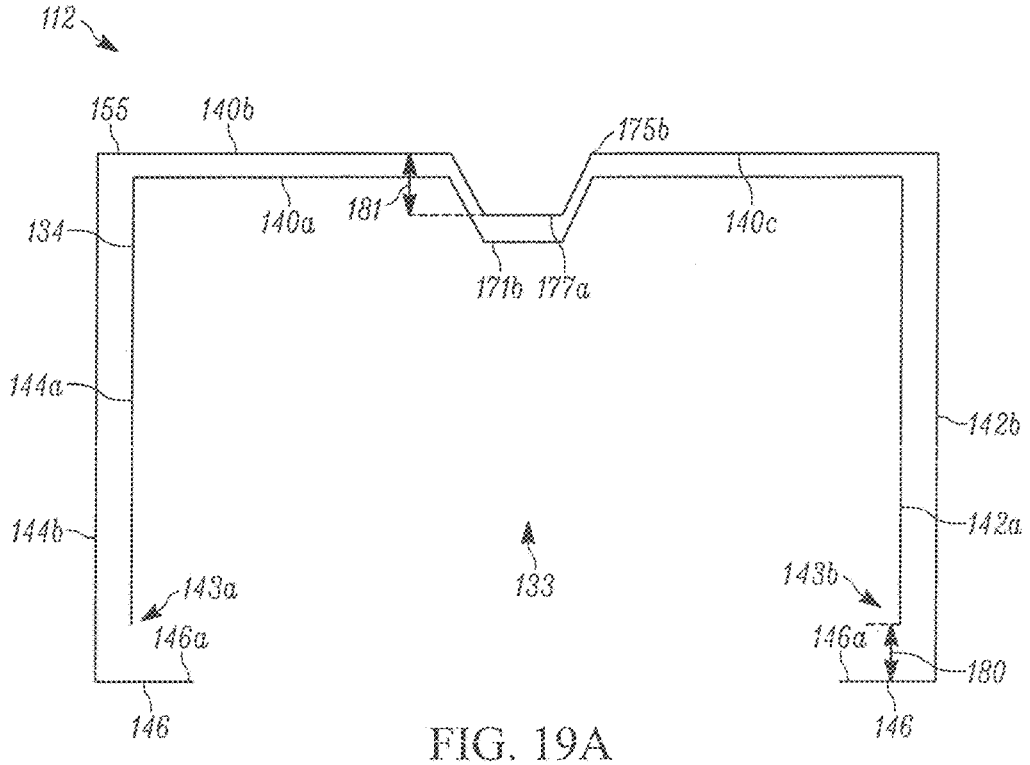
FIG. 19A is a schematic cross-section view of a spacer frame assembly taken along the line 19-19 of FIG. 16.
Figure 19B:
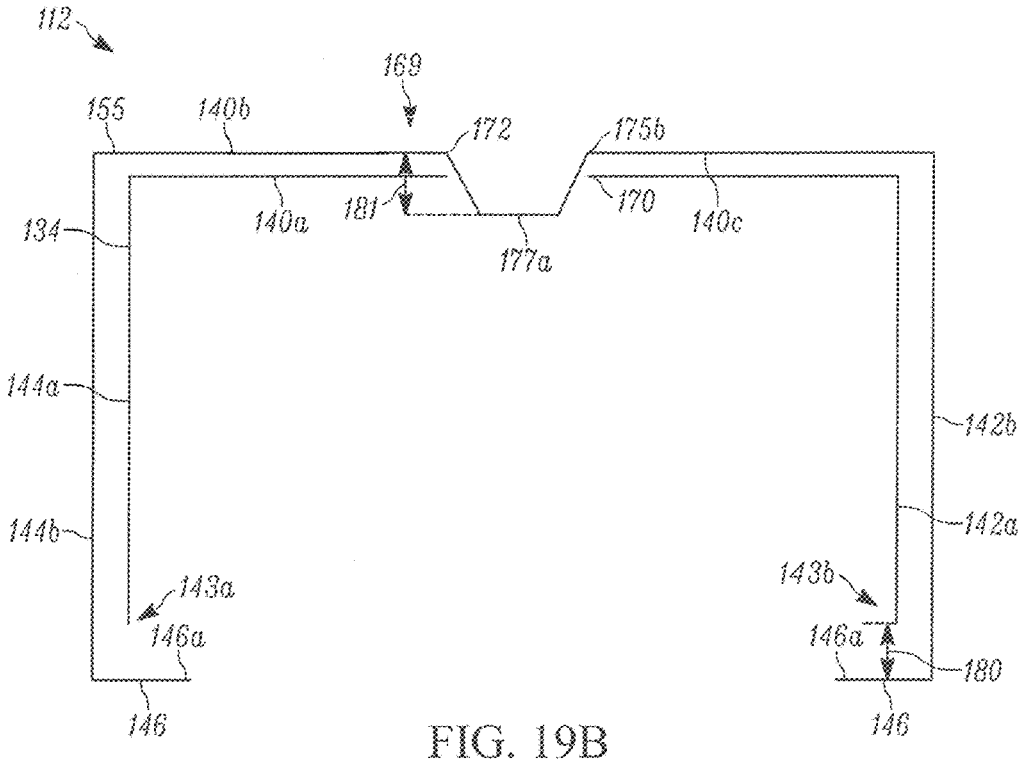
FIG. 19B is a schematic cross-section view of a spacer frame assembly taken along the line 19-19 of FIG. 16 wherein a single projection is present.
Figure 19C:
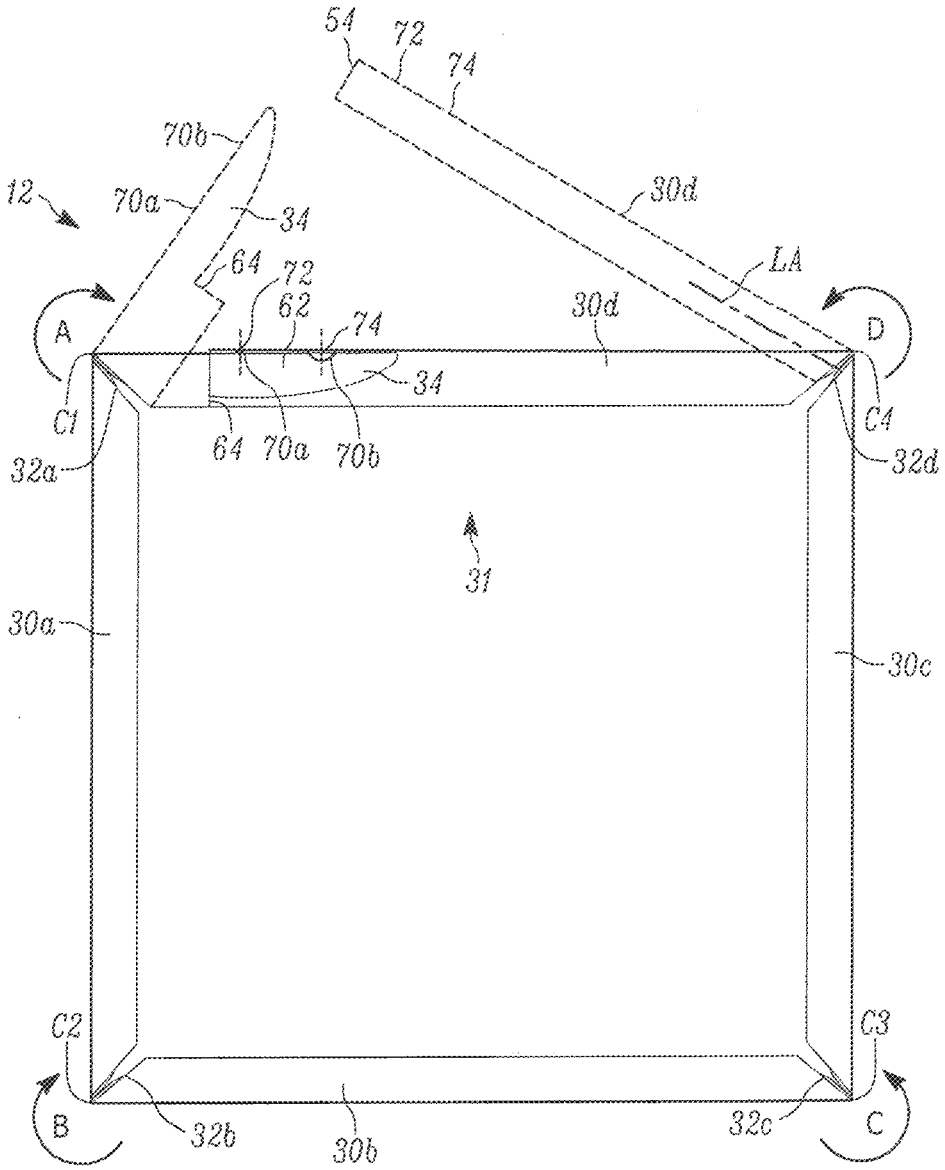
FIG. 19C is a front elevation view of a spacer frame constructed in accordance with another example embodiment of the present disclosure.

As in the illustrated embodiment of FIG. 19A, when assembled, a first distance 180, comprising a distance between an inward facing face 146*a* of the stiffening flanges 146 and the edges 143*a*, 143*b* of the lateral walls 142*a*, 144*a*, is less than a second distance 181. Wherein, the first distance 180 is measured when the base wall 140*a* of the connecting structure 134 is adjacent the base wall 140*b* of the opposite channel 155. The second distance 181 comprises a distance between an interior portion 140*c* of the base wall 140*b* of the opposite channel 155 and a most inwardly projecting point 177*a*, 177*b* of the third and fourth tab 175*a*, 175*b*, respectively. In one example embodiment, the first and second tabs 171*a*, 171*b*, extend a third distance 178 into the channel 133, wherein the third distance is measured from the base wall 140*a* to most inwardly projecting points 173*a*, 173*b*. In an example embodiment, the second and third distances 181, 178, are substantially the same. Thus, the first and second tabs 171*a*, 171*b* are tactilely connected 169 with the third and fourth tabs 175*a*, 175*b*. In an example embodiment, the connecting portion 134 comprises the first aperture 170 and the interruption of the peripheral edge 131, but lacks the first and second tabs 171*a*, 171*b*, such that the third and fourth tabs 175*a*, 175*b* tactilely connected with the interruption of the peripheral edge of the first aperture 170.

Illustrated in FIGS. 19C-19G is a spacer frame 12 constructed in accordance with another example embodiment of the present disclosure. The spacer frame 12 forms a friction connection 69 as further described below. The spacer frame 12 includes a first frame end or tongue 56 and an opposite channel or tail 55. In the illustrated example embodiment, the tongue 56 is received or enters into the channel formed by the tail 55.

Figure 19D:
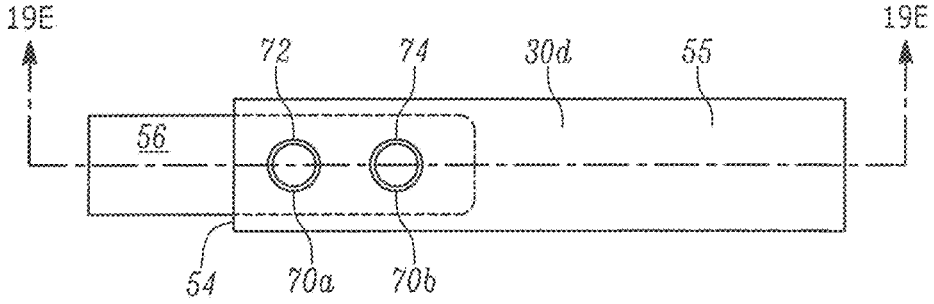
FIG. 19D is a top plan view of FIG. 19C.
Figure 19E:
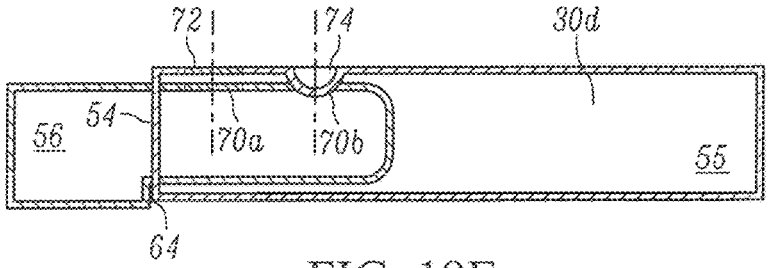
FIG. 19E is a partial sectioned front elevation view of FIG. 19D along section lines 19E-19E.
Figure 19F:
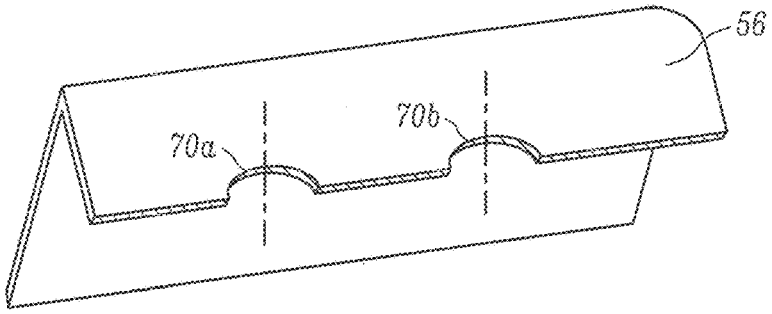
FIG. 19F is a partial disassembled perspective view of the section view of FIG. 19E.
Figure 19G:
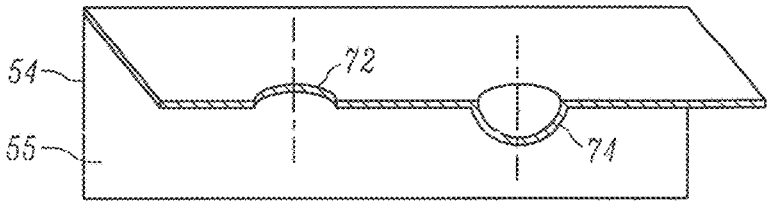
FIG. 19G is a partial disassembled perspective view of the section view of FIG. 19E.

The tongue 56 includes a first gas fill aperture 70*a* formed through the base wall 40*a* and a second aperture 70*b* formed through the base wall 40*a* for receiving a projection or bump 74. The projection or bump 74 is located on the tail or opposite channel 55, as illustrated in FIGS. 19D-19G. A friction connection 69 is formed when the bump or projection 74 is received into the opening of the second aperture 70*b*. In one example embodiment, the bump or projection 74 is a recess formed in the tail wall 55, as illustrated in FIGS. 19E and 19G. In another example embodiment, the bump 74 is a substantially annular dome, projecting inward toward the channel formed by the tail 55.

During assembly, the tongue 56 enters the channel of the tail 55, allowing the second aperture 70*b* to pass under the gas fill aperture 72 until the friction connection 69 is formed by the bump 74 dropping or nesting into the second aperture 70*b*. When the friction connection 69 and nesting of the bump 74 into the second aperture 70*b* is achieved, the first and second gas fill apertures are concentrically aligned, as illustrated in FIGS. 19D and 19E.

The friction connection 69 is a responsive tactile connection, in that it provides to the assembler feedback if there is over-travel or under-travel when advancing one or both of the connecting structure 34 and the opposite channel 55 towards each other. That is, the friction during assembly remains high during under-travel until the interweaving of the projection 74 is received in the second aperture 70*b* to form the friction or responsive tactile connection 69. Once the interweaving is achieved, the friction significantly diminishes between the base wall 40*a* and the projection 74. Similarly, if over-travel from the tactile connection 69 occurs, the friction significantly increases. This tactile response occurs because the second projection 74 rubs the base wall 40*a* of the connecting structure 34, until the tactile connection 69 is reached between the projection 74 and the second aperture 70*b*.

In one example embodiment, the projection or bump 74 is substantially domed shaped by a punch operation in the base wall 40 having a diameter that is slightly smaller than the second aperture 70*b* to allow for proper nesting (such that over travel is not easily achieved). In another example embodiment, the nesting of the bump 74 and second aperture 70*b* occurs simultaneously with the concentric alignment of the gas fill holes 70*a* and 72 and the lateral connection 60 formed by the stops 64 engaging the opposite frame end 54 during the telescopic connection 58 between the tongue 56 and tail 55. Advantageously, the concentric alignment of the gas fill apertures 70*a* and 72 is reassured based on the frictional tactile feedback connection 69 provided during assembly to the assembler, as described above, even without the telescopic union 58, or the lateral connection 60, as illustrated in FIG. 6, or even without engagement of the end 3*a* with the corner as illustrated in FIGS. 1A-1E.

Turning to FIGS. 20-33, a locking member 202 for use in the apertures 7, 70, 72, 170, 172 of a spacer frame assembly 1, 12, 112 is illustrated. The locking member 202 comprises a head portion 204 having a substantially planar top portion 210*a* and having a bottom portion 210*b*. The bottom portion 210*b* is coupled to a shaft 206. In an example embodiment, the head portion 204 comprises a head diameter 208 that is greater than a shaft diameter 236 of shaft 206.

In the illustrated example embodiment, the shaft 206 extends orthogonally from the head portion 204 along a longitudinal axis 230. The shaft 206 comprises a through-bore 206*a* defined by lateral walls 207 of the shaft 206 (see FIG. 22). In one example embodiment, the through-bore 206*a* extends from the head portion 204 through the shaft 206 along the longitudinal axis 230 (see FIG. 22). The shaft 206 further comprises a cross-bore 248 through the sidewalls 207 of the shaft 206 along a lateral axis 234 that intersects and is perpendicular to the longitudinal axis 230. The cross-bore 248 defines a first opening 246*a* and a second opening 246*b* in the sidewalls 207. In one example embodiment, the first opening 246*a* is opposite the second opening 246*b* along the lateral axis 234. In another example embodiment, the substantially planar top portion 210*a* is parallel to the lateral axis 234.

Figure 20:
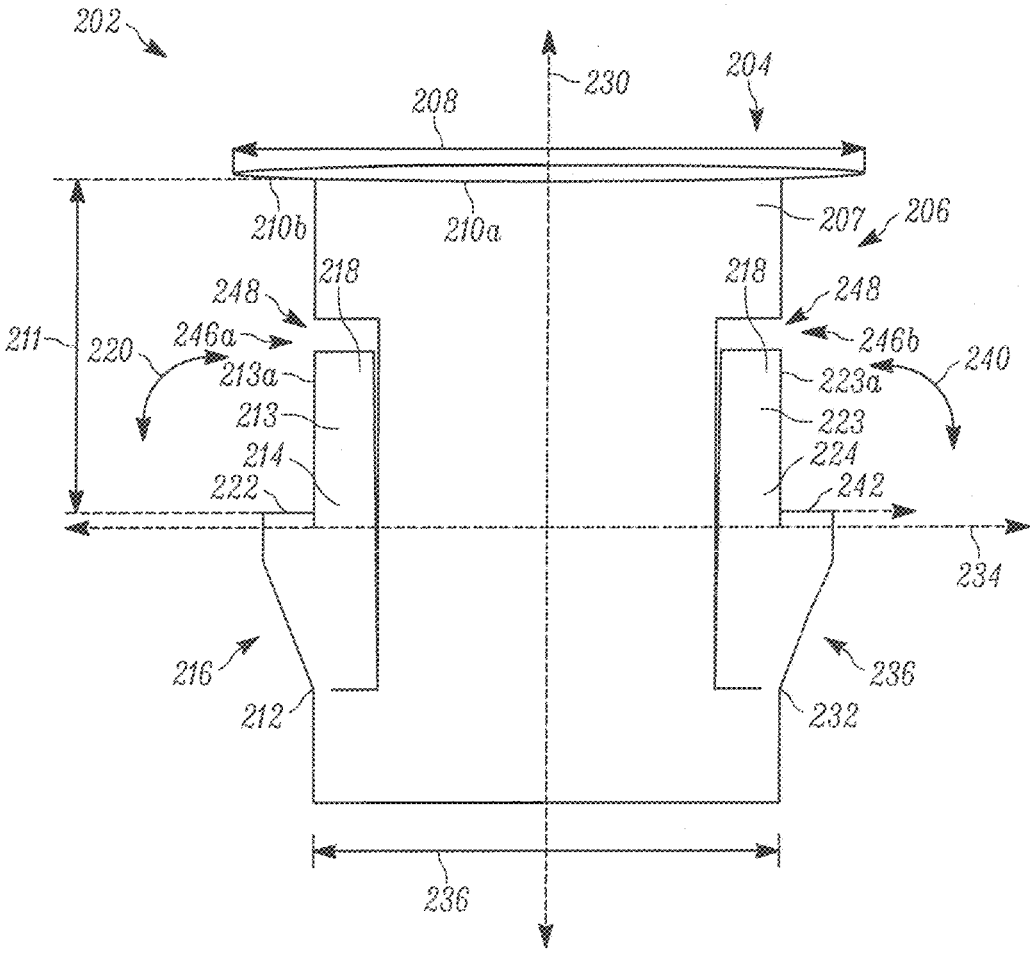
FIG. 20 is a front elevation view of a locking member in an un-flexed position in accordance with one example embodiment of the present disclosure.
Figure 21:
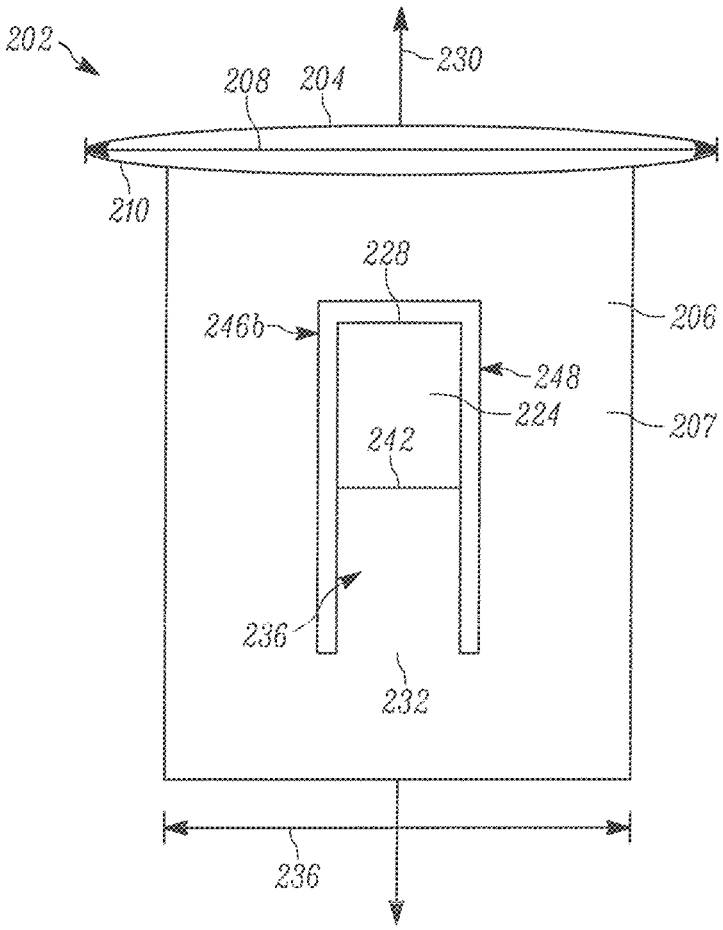
FIG. 21 is a front elevation view of FIG. 20 rotated 90° about a longitudinal axis.
Figure 22:
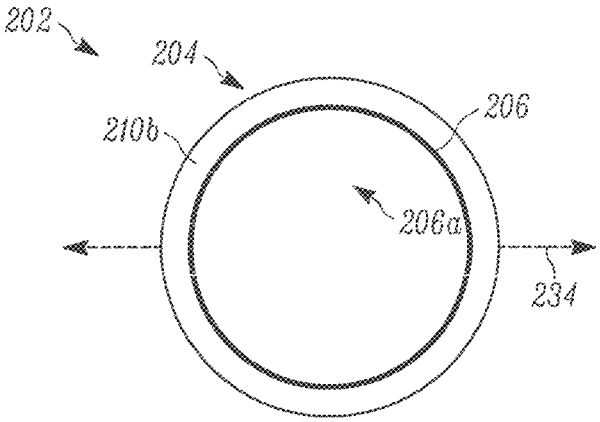
FIG. 22 is a bottom elevation view of FIG. 23.

The shaft 206 additionally comprises a first flex arm 214 extending from a first connection region 212 of the shaft 207. In one example embodiment, the first connection region 212 partially defines the first opening 246*a*. The first flex arm 214 further includes a first upright 218. The first upright 218 comprises a first ledge 216 extending transversely from the first upright. In one example embodiment, the first ledge 216 terminates at a first planar surface 222 parallel to the lateral axis 234 when the locking member 202 is in an un-flexed position, as illustrated in FIGS. 20-21. In an example embodiment, an upright tower portion 213 of the first upright 218 extends toward the head portion 204 from the first planar surface 222. In the example embodiment, the upright tower portion 213 comprises a first outer surface 213*a* that is parallel to the longitudinal axis 230 in the un-flexed position. In another example embodiment, the first outer surface 213*a* is co-axial with the sidewalls 207 of the shaft 206 when in the un-flexed position.

Figure 23:
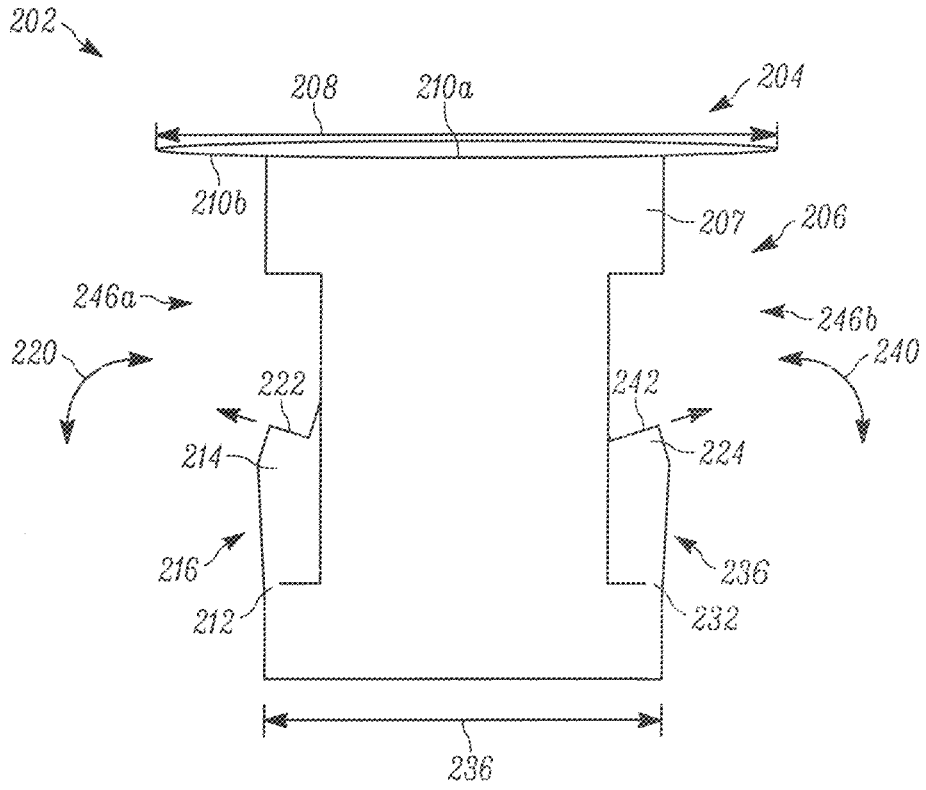
FIG. 23 is a front elevation view of a locking member in a flexed position in accordance with one example embodiment of the present disclosure.
Figure 24:
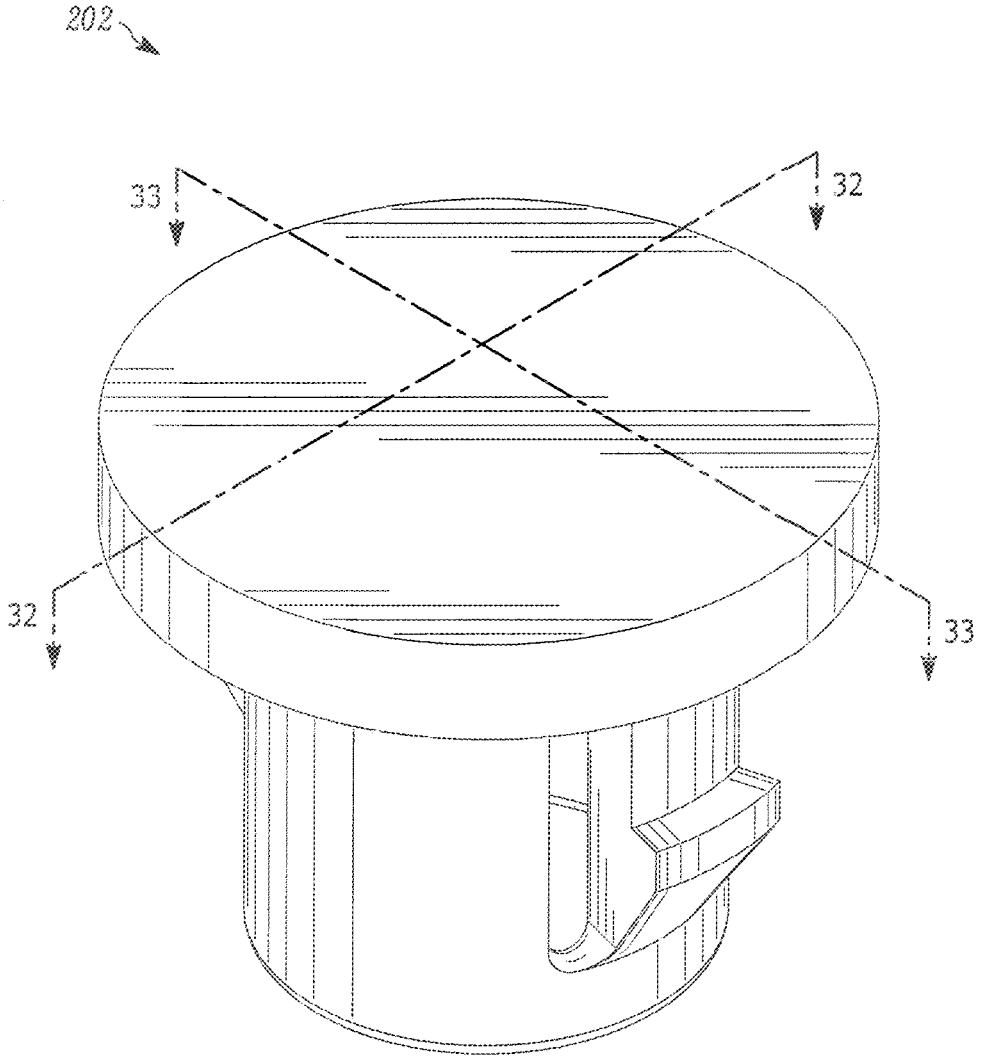
FIG. 24 is a top left perspective view of a locking member in an un-flexed position in accordance with one example embodiment of the present disclosure.
Figure 25:
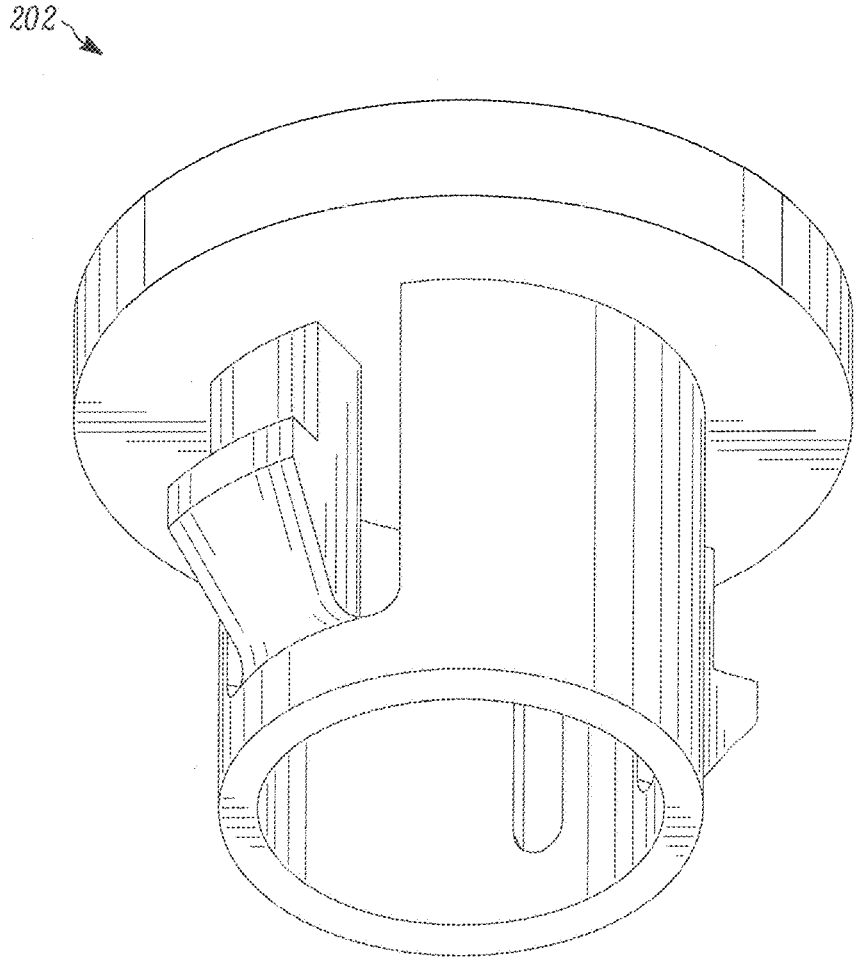
FIG. 25 is a bottom right perspective view of FIG. 24.
Figure 26:
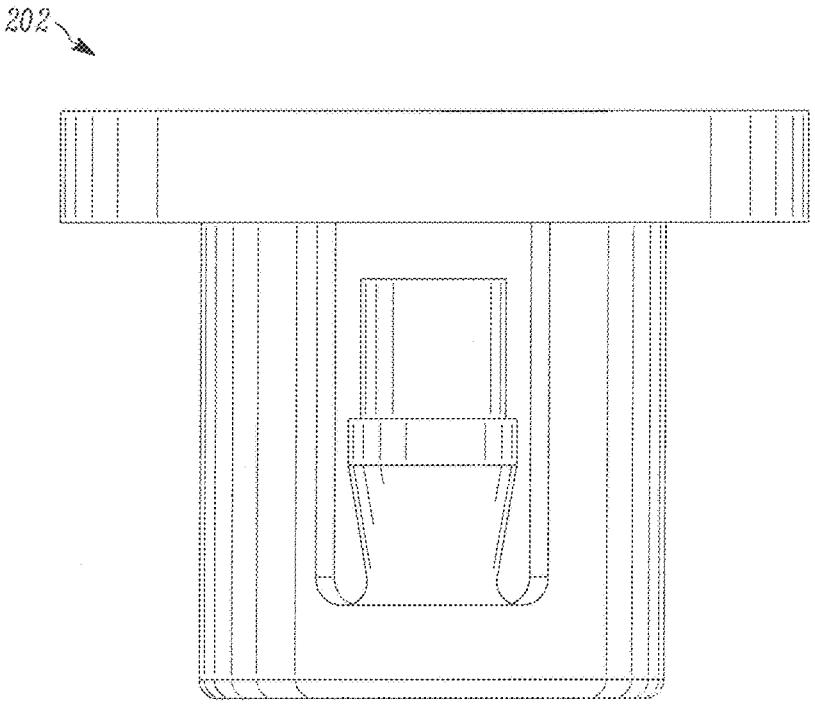
FIG. 26 is a right side elevation view of FIG. 24.
Figure 27:
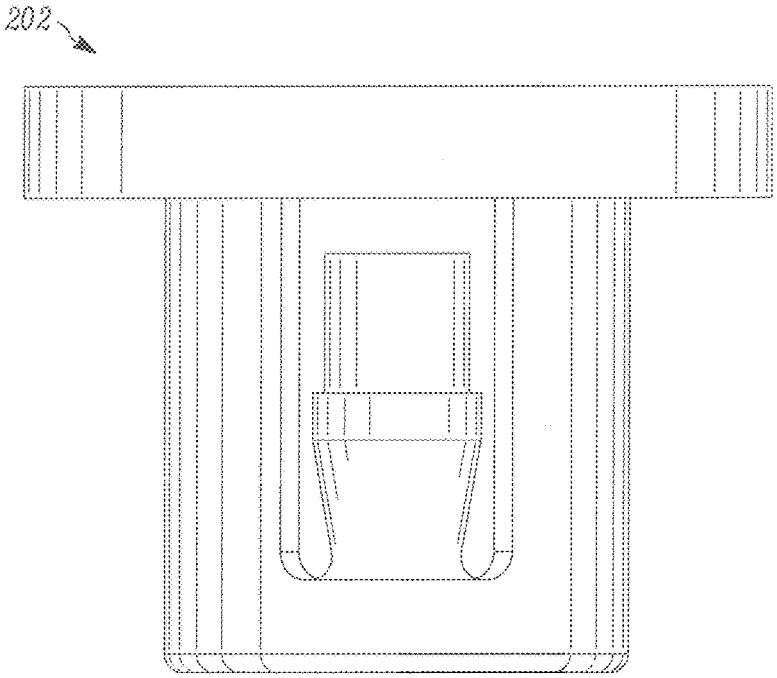
FIG. 27 is a left side elevation view of FIG. 24.
Figure 28:
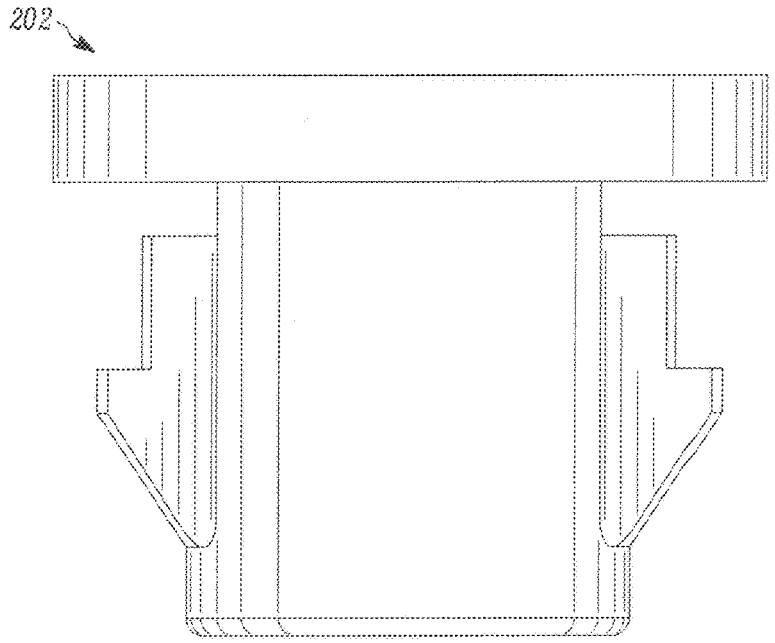
FIG. 28 is a front elevation view of FIG. 24.
Figure 29:
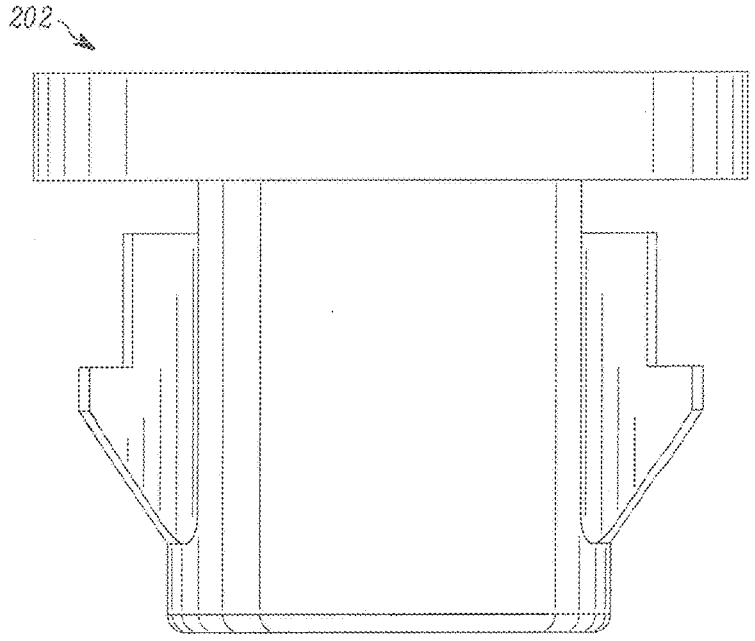
FIG. 29 is a rear elevation view of FIG. 24.
Figure 30:
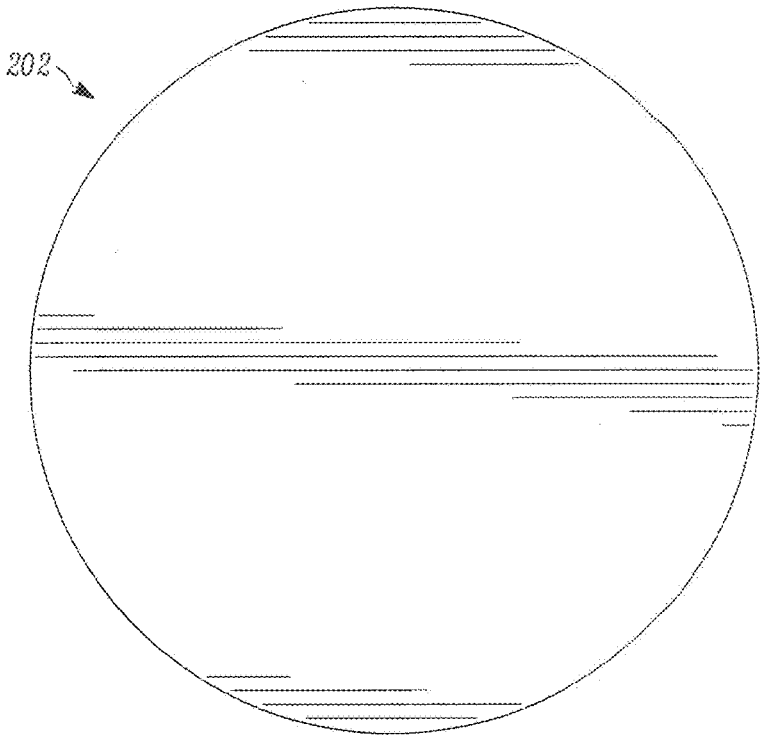
FIG. 30 is a top plan view of FIG. 24.
Figure 31:
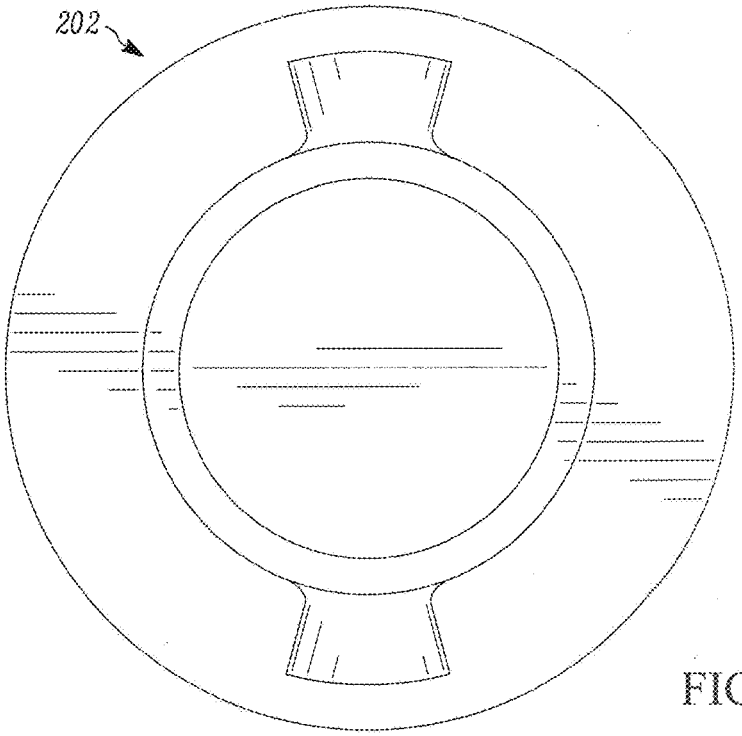
FIG. 31 is a bottom plan view of FIG. 24.
Figure 32:
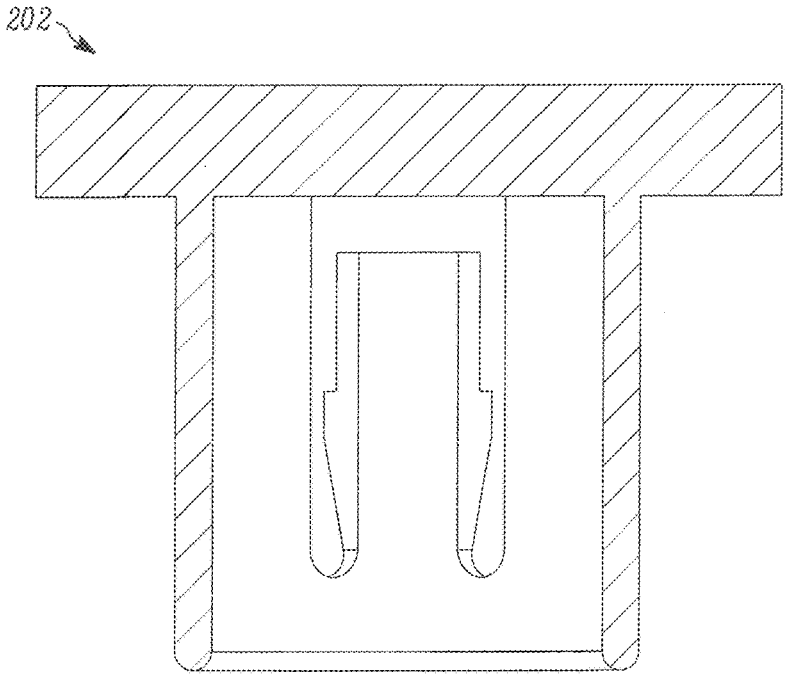
FIG. 32 is a cross-section of a right side view of FIG. 24 taken along lines 32-32 of FIG. 24.
Figure 33:
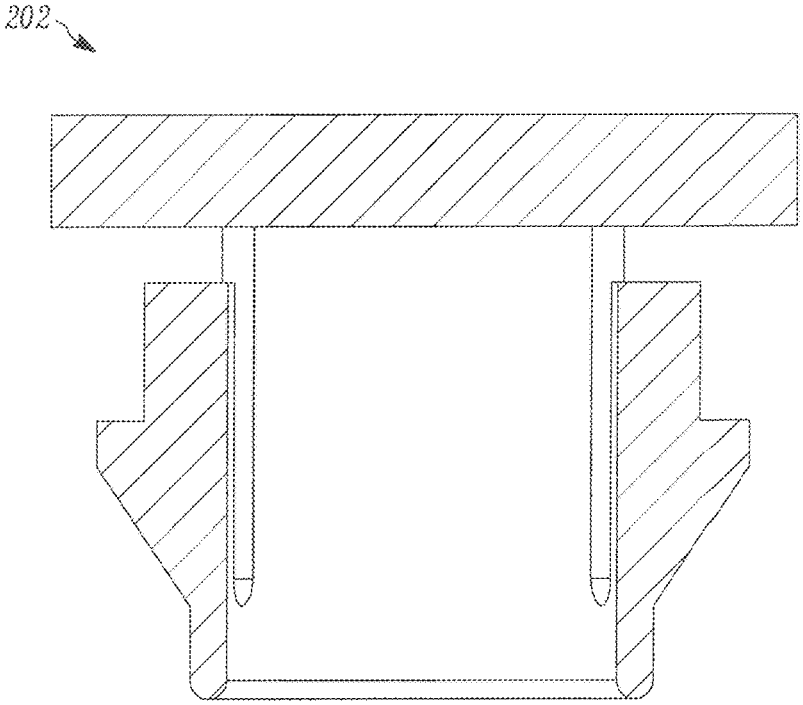
FIG. 33 is a cross-section of a front elevation view of FIG. 24 taken along lines 33-33 of FIG. 24.

As illustrated in FIGS. 20 and 23, the first flex arm 214 pivots 220 about the first connection region 212 toward the longitudinal axis 230 from the un-flexed position (see FIG. 20) and toward the lateral axis 234 from a flexed position (see FIG. 23). In the illustrated example of FIG. 23, the flexed position comprises the first flex arm 214 pivoted 220 into the first opening 246*a*, until the first ledge 216 is substantially co-axial with the sidewalls 207 of the shaft 206.

In the illustrated example embodiments of FIGS. 20-21, 23, the shaft 206 additionally comprises a second flex arm 224 extending from a second connection region 232 of the shaft. In one example embodiment, the second flex arm 224 is formed in substantially the same manner and has substantially the same dimensions as the first flex arm 214. In one example embodiment, the second connection region 232 partially defines the second opening 246*b*. The second flex arm 224 further includes a second upright 228. The second upright 228 comprises a second ledge 236 extending transversely from the second upright. In one example embodiment, the second ledge 236 terminates at a second planar surface 242 parallel to the lateral axis 234 in the un-flexed position. In an example embodiment, a second upright tower portion 223 of the second upright 228 extends toward the head portion 204 from the second planar surface 242. In the example embodiment, the second upright tower portion 223 comprises a second outer surface 223*a* that is substantially parallel to the longitudinal axis 230 in the un-flexed position, as illustrated in FIG. 20. In another example embodiment, the second ledge 236 is co-axial with the sidewalls 207 of the shaft 206, when in the flexed position. In yet another example embodiment, the first flex arm 214 and the second flex arm 224 pivot 220, 240 independently of each other.

In one example embodiment, the first planar surface 222 of the first flex arm 218 and the second planar surface 242 of the second flex arm 228 are a latching distance 211 from the bottom surface 210*b* of the head portion 204. The latching distance 211 is based upon a thickness of the two or more objects (e.g., the connecting portion 34, 134, and the opposite channel 55, 155) that the locking member latches together. The material forming the locking member 202 comprises metallic and/or non-metallic materials. In one example embodiment, the locking member 202 comprises at least one of nylon, thermo-plastic, metal (such as aluminum or stainless steel), or the like.

Figure 34A:
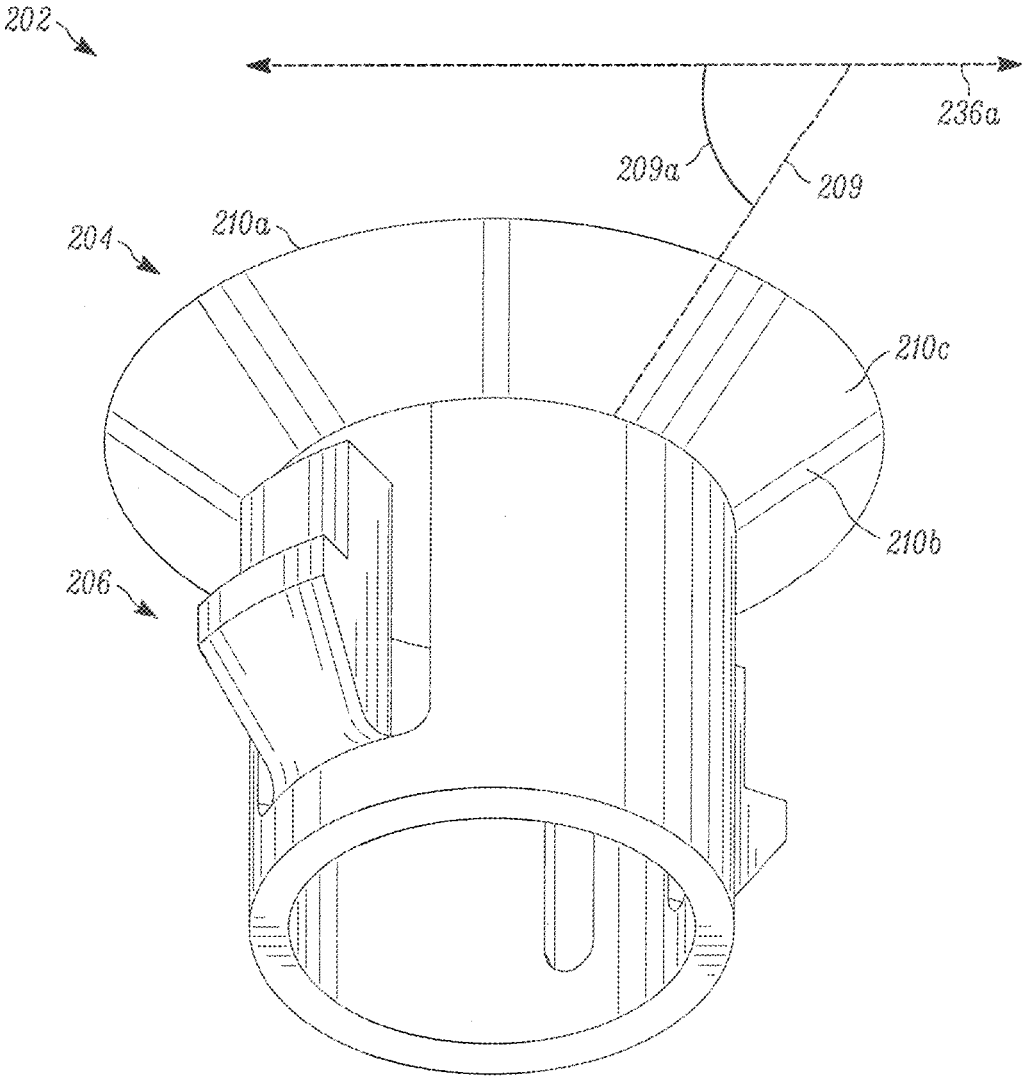
FIG. 34A is a bottom right perspective view of a locking member comprising a countersunk head portion in accordance with another example embodiment of the present disclosure.
Figure 34B:
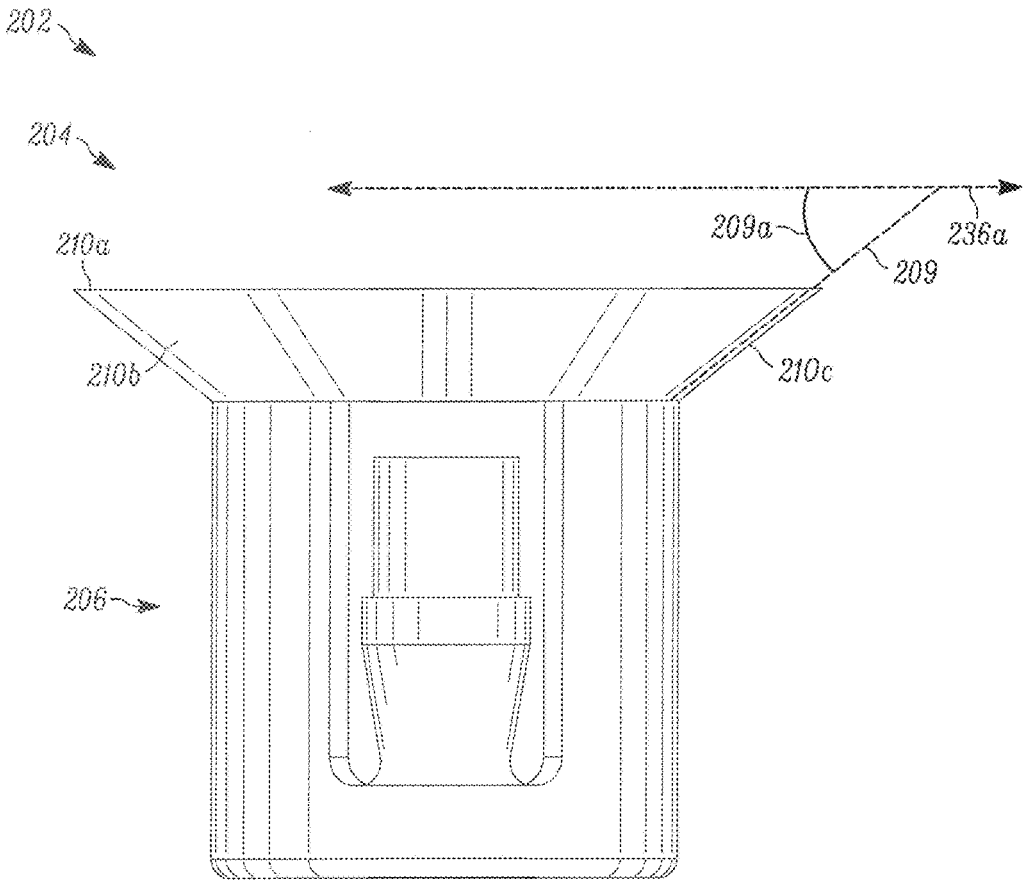
FIG. 34B is right side elevation view of a locking member comprising a countersunk head portion in accordance with another example embodiment of the present disclosure.

Turning to the illustrated example embodiment of FIGS. 34A-34B, the bottom portion 210*b* of the locking member 202 comprises a countersunk portion 210*c*. In one example embodiment, the countersunk portion 210*c* extends 209 from the planer surface 236*a* parallel to the lateral axis 236 of the top portion 210*a* of the head portion 204 to the shaft 206 at an angle 209*a* between 5° to about 85°. In another example embodiment, the angle 209*a* is substantially the same as at least one of the first and second angle 71*a*, 75*a* of the first and second projections 71, 75, and the first and second tab angles of the first and second apertures 170, 172.

Figure 35:
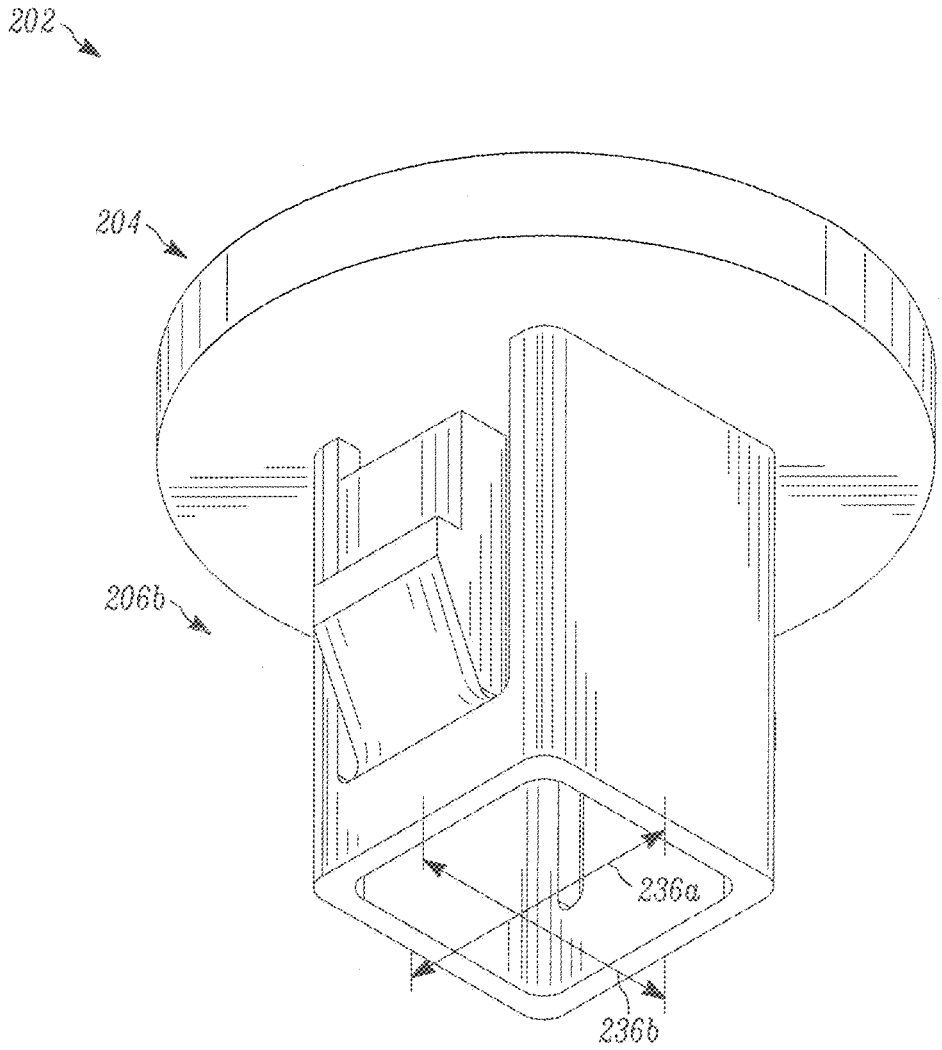
FIG. 35 is a bottom right perspective view of a locking member comprising a rectangular shaft portion in accordance with yet another example embodiment of the present disclosure.

Turning to the illustrated example embodiment of FIG. 35, the shaft 206 comprises a rectangular shaft 206*c*. In the illustrated example, the rectangular shaft 206*c* has a first side diameter 236*a* and a second side diameter 236*b*. The first side diameter 236*a* can be less than, equal to, or larger than the second side diameter 236*b*. In one example embodiment, the rectangular shaft 206*c* is configured to be housed within a similarly shaped aperture (e.g., a square or rectangular aperture).

Figure 36:
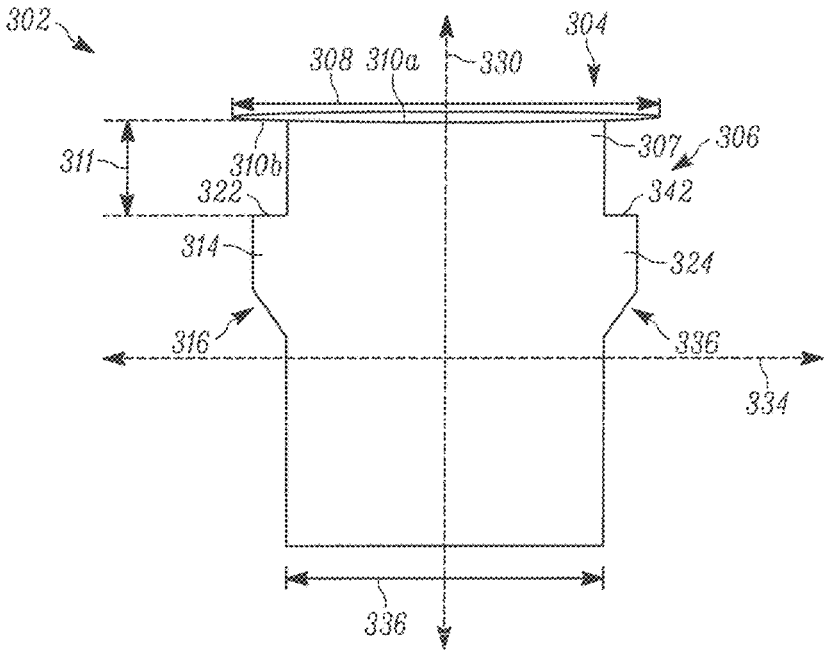
FIG. 36 is a front perspective view of a locking member in accordance with a third example embodiment of the present disclosure.
Figure 37:
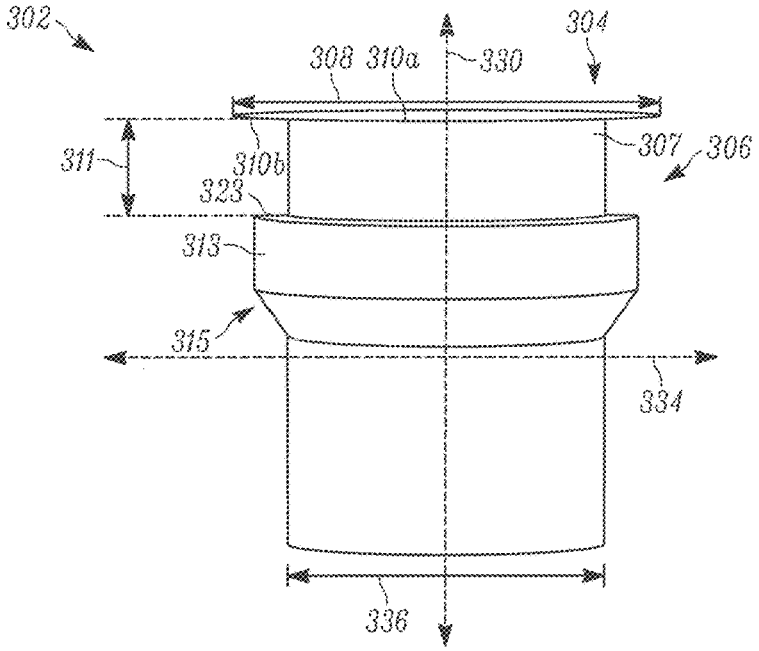
FIG. 37 is a front perspective view of a locking member in accordance with a third example embodiment of the present disclosure.

Turning to FIGS. 36-37, a second embodiment of the locking member 302 is illustrated. The locking member 302 as illustrated in FIGS. 36-37 is substantially similar to the locking member 202 as illustrated in FIGS. 20-33 with shared features being identified by the same numeral increased by a factor of 100 from 200 to 300. A primary change from the locking member 202 is that the locking member 302 comprises a protrusion 313 or first and second protrusions 314 and 324 in place of the first and second flex arms 214, 224.

As illustrated in FIG. 36, the shaft 306 comprises the first and second protrusions 314, 324 extending from the sidewalls 307 of the shaft. In an example embodiment, the first and second protrusions 314 and 324 are opposite each other relative to the longitudinal axis 330. In another example embodiment, the first and second protrusions 314 and 324 encircle a majority of the shaft 306, such that the first and second protrusions are separated by small gaps (not shown). In yet another embodiment, multiple protrusions (not shown) extend from the sidewalls 307 of the shaft 306.

The sidewalls 307 are substantially parallel to the longitudinal axis 330. In one example embodiment, the first protrusion 314 comprises a first ledge 316 extending transversely from the sidewalls 307 of shaft 306 and the second protrusion 324 comprises a second ledge 336 extending transversely from the sidewalls. In another example embodiment, the first ledge 316 and the second ledge 336 extend at a first angle away from the sidewalls 307, wherein the first angle is between 80° to about 10°. In one example embodiment, the first ledge 316 terminates at a first planar surface 322 substantially parallel to the lateral axis 334 and the second ledge 336 terminates at a second planar surface 342 substantially parallel to the lateral axis 334. In one example embodiment, the first planar surface 322 and the second planar surface 342 are the latching distance 311 from the bottom surface 310*b* of the head portion 304, as described above with regard to the latching distance 211 of FIG. 20.

As illustrated in FIG. 37, a slightly altered embodiment of the locking member 302 is illustrated. The slight alteration being that the locking member 302*a* comprises a single protrusion 313. In one example embodiment, the protrusion 313 encircles the shaft 306. In one example embodiment, the protrusion 313 comprises a ledge 315 extending transversely from the sidewalls 307 of the shaft 306. In another example embodiment, the ledge 315 extends at the first angle relative to the sidewalls 307. In one example embodiment, the ledge 315 terminates at a planar surface 323 substantially parallel to the lateral axis 334. In one example embodiment, the planar surface 323 is the latching distance 311 from the bottom surface 310*b* of the head portion 304, as described above with regard to the latching distance 211 of FIG. 20.

Turning to FIGS. 38-41, the locking member 202 is illustrated in use with an assembled spacer frame assembly 12. Although, the locking member 202 and the spacer frame assembly 12 is illustrated, one of ordinary skill in the art would realize that various combinations of the locking member 302, 302*a* and the spacer frame assembly 112 could also be used. Additionally, the locking member 202 can be used to interlock the legs 2*a* and 2*e* of the spacer frame assembly 1, illustrated in FIGS. 1A-1E.

Figure 38:
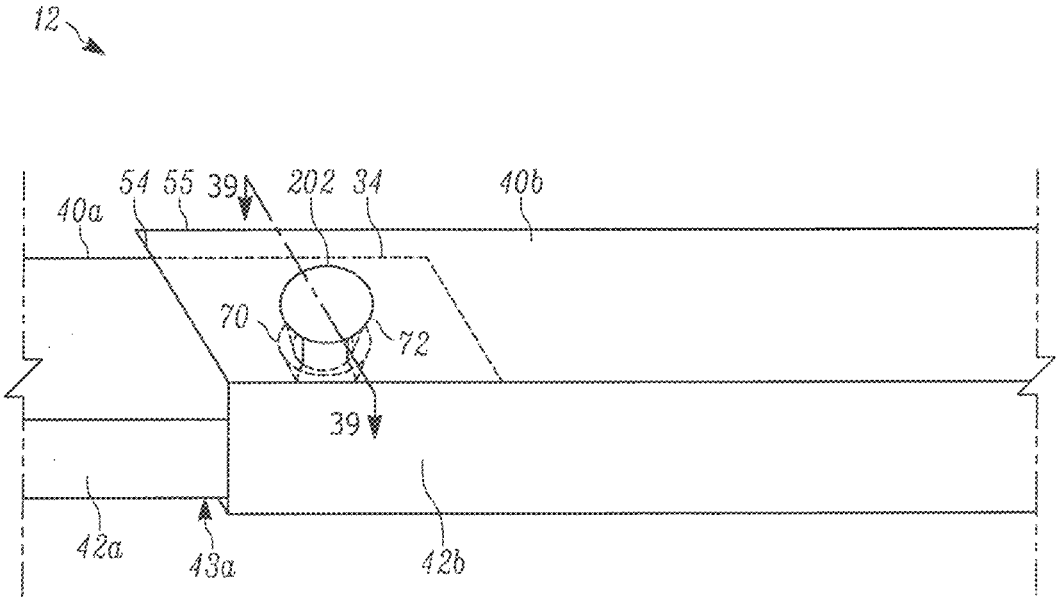
FIG. 38 is a perspective view of a section of a spacer frame assembly in an assembled position during insertion of a locking member in accordance with a fourth example embodiment of the present disclosure.
Figure 39:
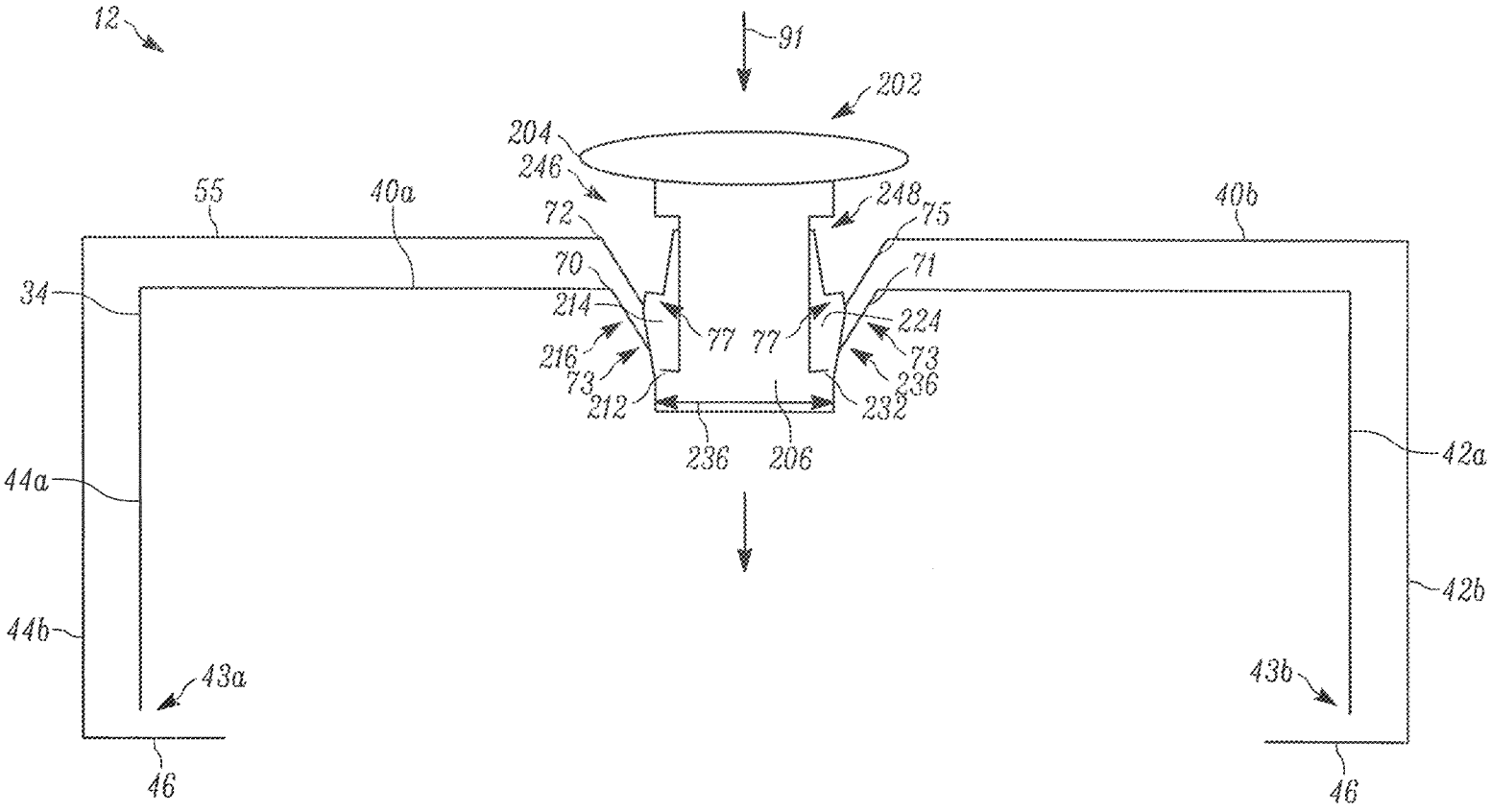
FIG. 39 is a schematic cross-section view taken along the line 39-39 of FIG. 38, wherein a locking member is being inserted into a spacer frame assembly.

In the illustrated example embodiment of FIG. 38, the locking member 202 is housed in the concentrically aligned first and second apertures 70, 72. The locking member 202 prevents air leakage out of the first and second apertures 70, 72, and prevents the spacer frame assembly 12 from disassembling (e.g., misaligning the first and second apertures, or separating the connecting structure 34 and the opposite channel 55). As in the illustrated example of FIG. 39, the locking member 202 is inserted through the first and second aperture 70, 72. During insertion 91, interaction between the ledges 216, 236 and the most inwardly projecting points 77, 73 of the first and second projections 75, 71 respectively, pivot 220, 240 the first and second flex arms 214, 224 into the first and second openings 246, 248. The angle of the ledges 216, 236 and the pivoting action allows the shaft 206 of the locking member 202 to fit within the first and second apertures 70, 72. In an example embodiment, the shaft diameter 236 is less than the narrowest diameter of the apertures 70, 72, and/or the projections 71, 75.

Figure 40:
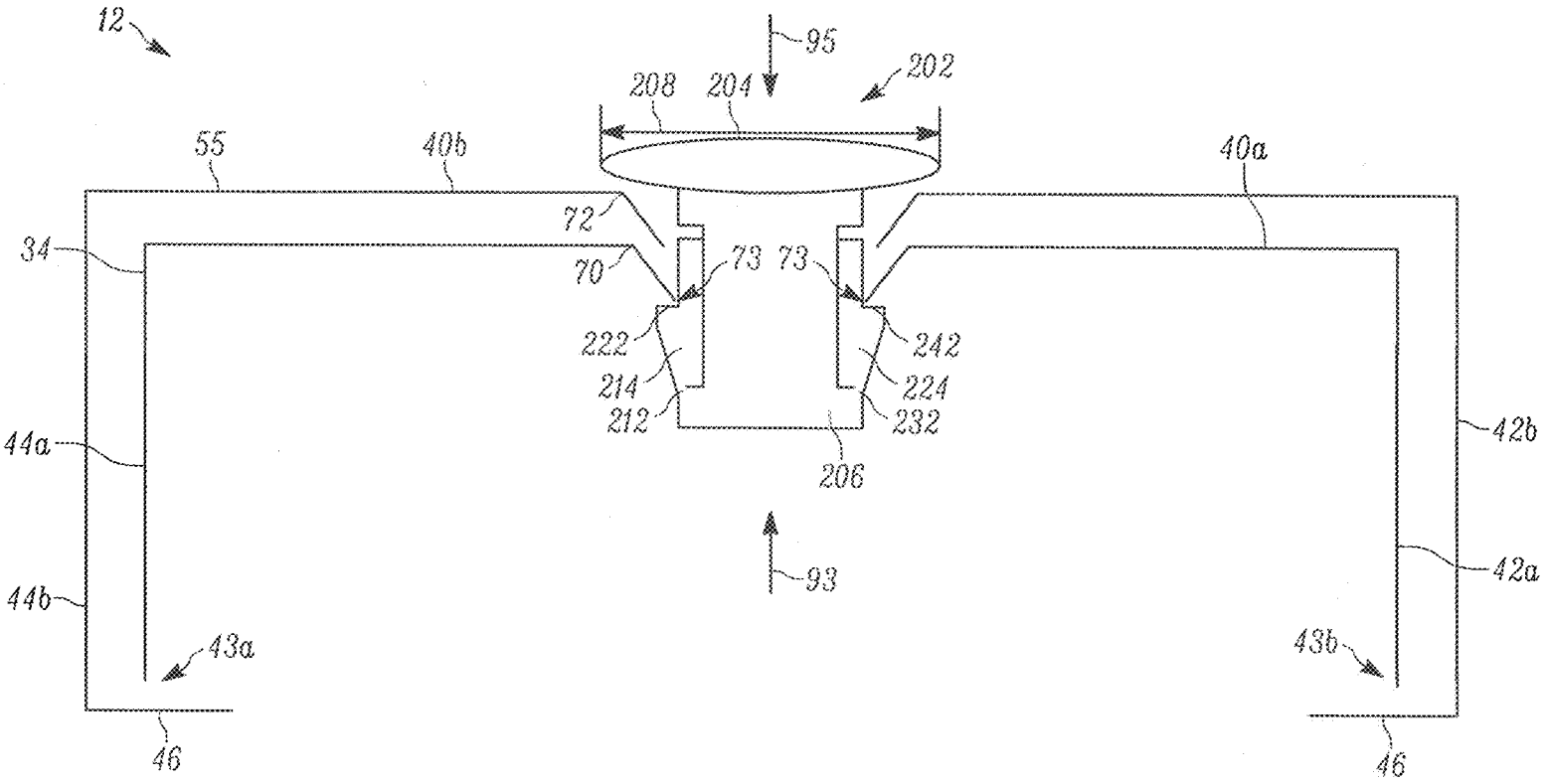
FIG. 40 is a schematic cross-section view taken along the line 39-39 of FIG. 38.

Once the ledges 216, 236 pass through the first and second apertures 70, 72 and go past the most inwardly projecting point 73, the first and second flex arms 214, 224 pivot 220, 240 back to the un-flexed position as illustrated in FIG. 40. Once in the un-flexed position, the first and second planar surfaces 222, 242 interact with the most inwardly projecting point 73 to prevent the locking member 202 from exiting the first and second apertures 70, 72 in a first longitudinal direction 93. The head portion 204, having the diameter 208 greater than a diameter of the first and second apertures 70, 72, prevents the locking member 202 from exiting the first and second apertures in a second longitudinal direction 95. In an example embodiment, the shaft diameter 236 comprises a diameter less than a diameter 73*a*, 77*a* of the most inwardly projecting points 73, 77 (see FIGS. 8-9).

In one example embodiment, the protrusion 313 or the first and second protrusions 314 and 324, function in substantially the same manner as the first and second flex arms 214, 224. For example, the ledge 315 or the first and second ledges 316, 336 act as the ledges 216, 236, allowing insertion of the shaft 306 through the first and second apertures 70, 72 based upon the angle of the ledge or first and second ledges. Further, the planar surface 323, or the first and second planar surfaces 322, 342 interact with the most inwardly projecting point 73 to prevent the locking member 302 from exiting the first and second apertures 70, 72.

Figure 41:
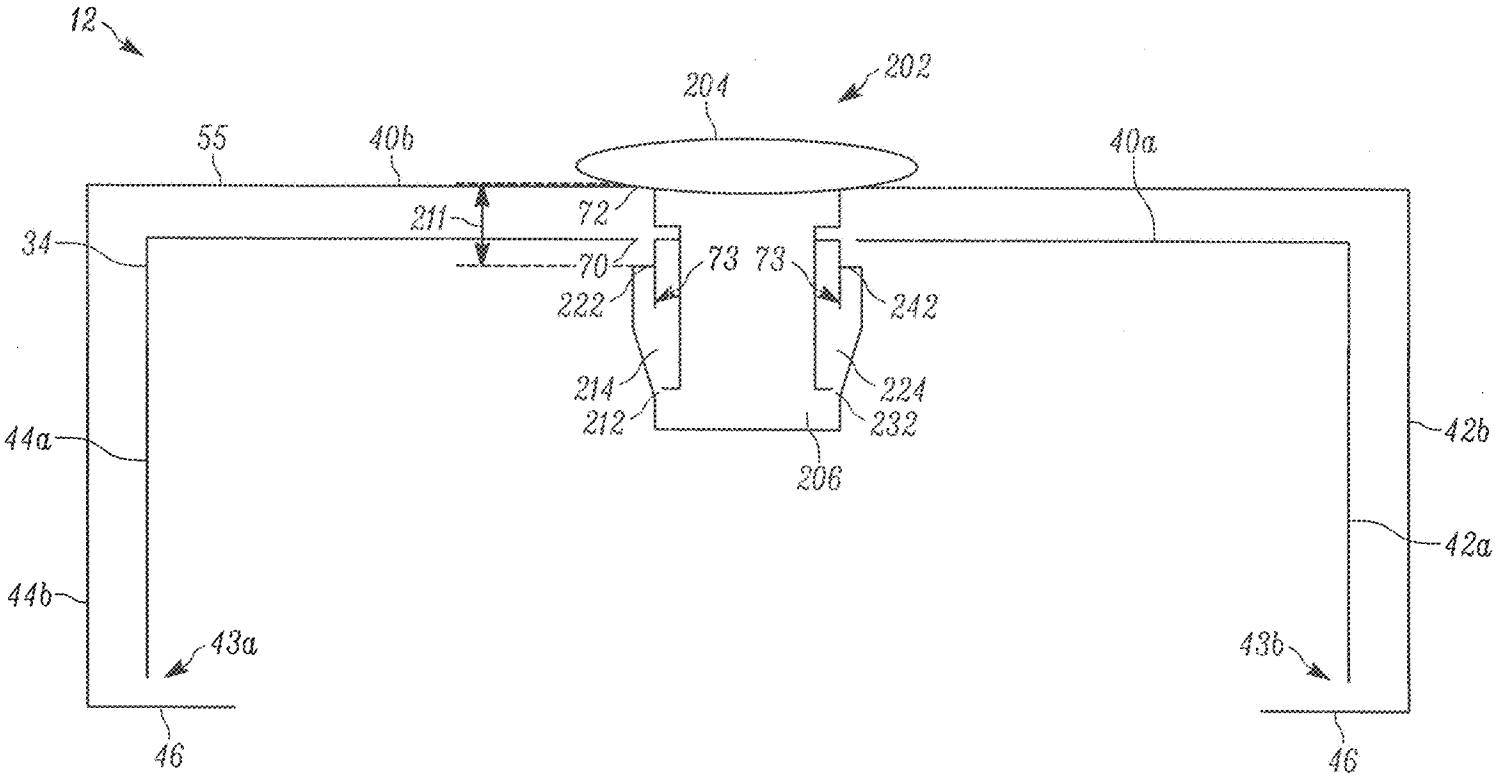
FIG. 41 is a schematic cross-section view taken along the line 39-39 of FIG. 38, wherein a spacer frame assembly lacks projections.

In the illustrated example embodiment of FIG. 41, the locking member 202 is illustrated as being housed within the first and second apertures 70, 72, wherein, there are no first or second projections, an example embodiment, the latching distance 211 is altered to account for the lack of the projections (e.g., the latching distance is reduced). In an example embodiment, the locking member 202 is fabricated such that the latching distance 211 is slightly longer than a distance between a top surface of the base wall 40*b* and the most inwardly projecting point 73 or the most inwardly projecting point 77 (e.g., in the absence of the first projection 71), or in the absence of the first and second projections 71, 75, an inner surface of the base wall 40*a*.

Figure 42:
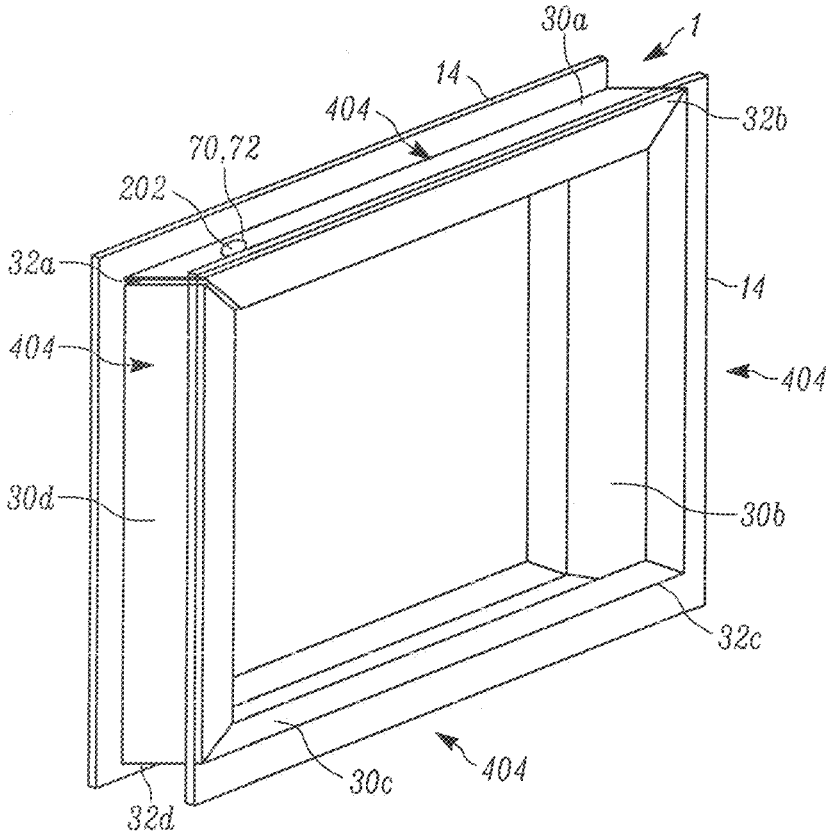
FIG. 42 is a perspective view of a conventional spacer frame, including glass lites, in an assembled position housing a locking member in accordance with an example embodiment of the present disclosure.
Figure 43:
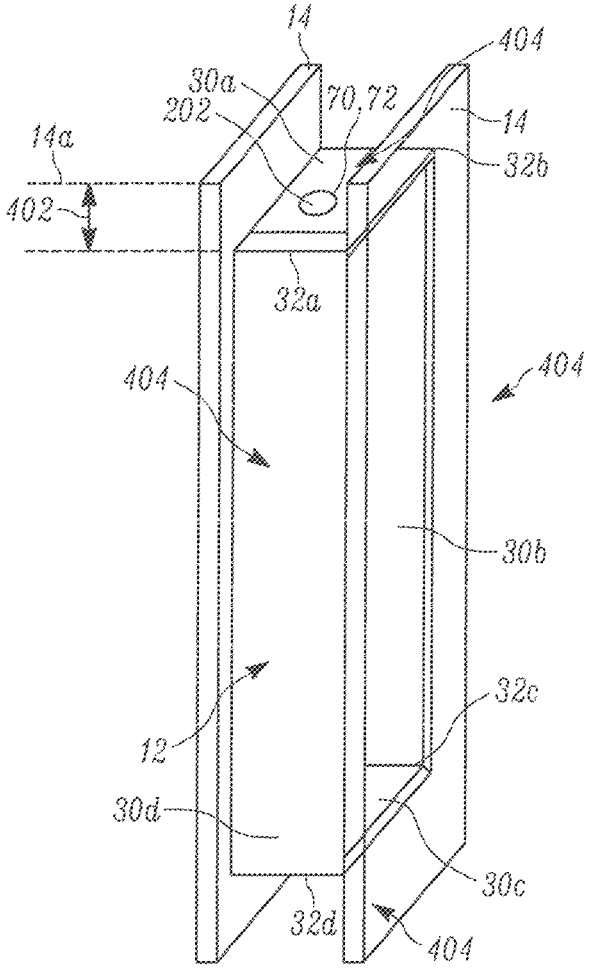
FIG. 43 is a perspective view of an insulating glass unit, including glass lites, in an assembled position housing a locking member in accordance with an example embodiment of the present disclosure.

Before the locking member 202 is housed within the first and second apertures 70, 72, lites 14 are coupled to opposing sides of the assembly 1, 12, as illustrated in FIGS. 42 and 43, respectively. Typically, sealant 404 is applied around the sides 30*a*-30*d* and over the corners 32*a*-32*d* to form the insulating air space 20 between the lites 14 and the assembly 1, 12. The sealant is not applied over the apertures 70, 72. The gas fill apertures 70, 72 are used to evacuate and/or add specific fluids, for example, removing atmospheric air (oxygen, nitrogen, etc.) and adding other fluids, such as inert gases like argon. Traditionally, once the insulating air space 20 has a desired composition, a screw or rivet is used to seal the air inside. Sealant 404 is then applied over the screw or rivet. The sealant 404 is typically applied up to a plane 14*a* that is even with or below a top plane on which the edges of the lites 14 reside. If the rivet or screw is not inserted correctly, the rivet or screw will exceed a height 402 of the lite 14 above the assembly 1, 12, causing window failure. Further, a head of the rivet or screw adds additional surface areas that add additional point of sealant 404 unevenness and/or thin spots. The unevenness and/or thin spots are points of failure for window failure. Further, the rivet or screw head adds a bump during the application of the sealant 404. The locking member 202 has a flat planer head 204 and locks into place, such that the head is substantially flush with the base wall 40*b* of the assembly 12 (e.g., based upon the latching distance 211 being tailored to the assembly 12). The locking member 202 reduces additional surface areas that the sealant 404 has to adhere to, reducing instances of sealant and thus window failure. Further, the locking member 202 is difficult to misalign as a small force inserts the locking member, relative to the rivet, and no screwing action is required, where threads may catch and separate the connecting structure 34 from the opposite channel 55. In addition, the projections 71, 75 resembling a truncated pseudo-sphere facilitates the insertion of the locking members 202, 302, as the wall of the gas fill apertures 70, 72 resemble a funnel guiding the locking members accordingly.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A spacer frame assembly comprising: a substantially linear channel comprising two lateral walls connected by a base wall, the channel having first and second ends that when assembled, includes at least three sides and corresponding corners between each of said sides;

a connecting structure comprising a nose portion of the first end and a second receiving portion of said second end that comprises a channel portion of the channel for receiving the nose portion of said connecting structure, the channel portion comprising stiffening flanges extending inwardly from the lateral walls relative to the channel portion; and said connecting structure comprising a first through-hole in the base wall of one of said nose portion and said receiving portion and a second through-hole in the base wall of the other of said nose portion and said receiving portion and a projection bordering the second through-hole wherein, the projection tactilely interweaves with the first through-hole when assembled, wherein a first projection of said first through-hole comprised in the one of said nose portion and said receiving portion tactilely interweaves with the projection when assembled.

2. The assembly of claim 1, wherein said nose portion comprises the first through-hole in the base wall, said receiving portion comprises the projection defined by the second through-hole in the base wall, the projection projecting into the channel portion, wherein the projection tactilely interweaves with the first through-hole when assembled.

3. The assembly of claim 1, wherein said nose portion comprises the projection defined by the second through-hole in the base wall, said receiving portion comprises the first through-hole in the base wall, the projection projecting out of the channel portion, wherein the projection tactilely interweaves with the first through-hole when assembled.

4. The spacer frame of claim 1, wherein when assembled, a first distance, comprising a distance between an inward facing face of the stiffening flanges on the channel portion and a top edge of the lateral walls opposite the base wall of the connecting structure, is less than a second distance, wherein the second distance comprises a distance between an interior portion of the base wall of the channel portion and a farthest projecting point of the projection.

5. The spacer frame of claim 1, wherein the first through-hole defines a substantially circular opening having a first diameter at the base wall and a second diameter at a farthest projecting point of the first projection, wherein the first diameter is larger than the second diameter.

6. The spacer frame of claim 5, wherein the second through-hole defines a substantially circular opening having the first diameter at the base wall and the second diameter at a farthest projecting point of the projection.

7. The spacer frame of claim 1, wherein the first projection and the projection extend a substantially same distance from respective base walls into respective channels.

8. The spacer frame of claim 1, wherein at least one of the first through-hole and the second through-hole defines a substantially circular opening having a peripheral edge, the peripheral edge interrupted by the first projection, or projection, respectively, comprising a first tab extending radially from a first interruption in the peripheral edge into the channel from the base wall and a second tab, opposite the first tab, extending radially from a second interruption into the channel from the base wall.

9. The spacer frame of claim 1, wherein at least one of the projection and the first projection comprises a first tab and a second tab and a rectangular indentation overlaying a substantially circular opening of the through-hole, wherein the rectangular indentation comprises a first longer side parallel to a second longer side, the first and second longer sides connected by a first shorter side and a second shorter side, wherein the first shorter side is parallel to the second shorter side, and wherein, the first and second longer sides of the rectangle are greater than a diameter of the substantially circular opening, and wherein the first and second tabs extend radially from the first and second shorter sides of the rectangle, respectively.

10. The assembly of claim 1, wherein said first and second through-holes are substantially interweaving funnels.

11. The assembly of claim 1, wherein said first and second through-holes are first and second spacer frame gas fill apertures.

12. The spacer frame of claim 9, wherein at least one of the projection and the first projection extend into the channel.

13. The spacer frame of claim 9, wherein the first and second longer sides of the rectangular indentation extend parallel to the lateral walls.

14. The spacer frame of claim 1, wherein the projection located on the receiving portion comprises a first tab and a second tab and a rectangular indentation overlaying a substantially circular opening of the second through-holes, wherein the rectangular indentation comprises a first longer side parallel to a second longer side, the first and second longer sides connected by a first shorter side and a second shorter side, wherein the first shorter side is parallel to the second shorter side, and wherein, the first and second longer sides of the rectangle are greater than a diameter of the substantially circular opening, and wherein first and second tabs extend radially from the first and second shorter sides of the rectangle, respectively.

15. The spacer frame of claim 14, wherein the first through-holes on the nose portion comprises a second rectangular indentation overlaying a substantially circular opening of the first through-holes, wherein the second rectangular indentation comprises a third longer side parallel to a fourth longer side, the third and fourth longer sides connected by a third shorter side and a fourth shorter side, wherein the third shorter side is parallel to the fourth shorter side, and wherein, the third and fourth longer sides of the rectangle are greater than a diameter of the substantially circular opening, said the second rectangular indentation, tactilely interweaving with the rectangular indentation and the first and second tabs when assembled.

16. The spacer frame of claim 15, wherein third and fourth tabs extend radially from the third and fourth shorter sides of the rectangle, respectively, said the second rectangular indentation, and the third and fourth tabs tactilely interweave with rectangular indentation and the first and second tabs when assembled.

17. A spacer frame comprising: two lateral walls connected by a base wall to form a channel having first and second ends that when assembled, includes at least three sides and corresponding corners between each of said sides;

a connecting structure comprising a nose portion of the first end and a second receiving portion of said second end comprising a channel portion of the channel for receiving the nose portion of said connecting structure, the channel portion comprising stiffening flanges extending inwardly from the lateral walls relative to the channel portion, said connecting structure comprising a first gas fill through-holes in the base wall of said nose portion and a second gas fill through-holes the base wall in said receiving portion; and the first gas fill through-holes in the base wall of said nose portion and a projection extending from said receiving portion interact such that upon assembly of the connecting structure, the projection of the receiving portion forms a snap connection when said projection tactilely interweaves with the first gas fill through-holes of said nose portion, wherein said first and second gas fill through-holes are aligned responsive to the projection tactilely interweaving with the first gas fill through-holes wherein a first projection of said first gas fill through-hole comprised in said nose portion tactilely interweaves with the projection when assembled.

18. A spacer frame assembly comprising: a substantially linear channel comprising two lateral walls connected by a base wall, the channel having first and second ends that when assembled, includes at least three sides and corresponding corners between each of said sides;

a connecting structure comprising a nose portion of the first end and a second receiving portion of said second end, a channel portion of the channel for receiving the nose portion of said connecting structure, the channel portion comprising stiffening flanges extending inwardly from the lateral walls relative to the channel; and said connecting structure comprising a through-holes in the base wall of said nose portion and a second through-holes in the base wall of said receiving portion and a projection bordering the second through-holes, wherein the second through-holes defines a substantially circular opening having a first diameter at the base wall and a second diameter at a farthest projecting point of the projection, wherein the first diameter is larger than the second diameter, wherein when assembled, a first distance, comprising a distance between an inward facing face of the stiffening flanges on the receiving portion and an edge of the lateral walls opposite the base wall of the nose portion, is less than a second distance, wherein the second distance comprises a distance between an interior portion of the base wall of the receiving portion and the farthest projecting point of the projection wherein a first projection of said first through-hole comprised in the nose portion tactilely interweaves with the projection when assembled.

* * * * *